US005313670A

United States Patent [19]

Archer, III

[11] Patent Number: 5,313,670

[45] Date of Patent: May 24, 1994

[54] CERVICAL PROTECTION SYSTEM

[75] Inventor: Shreve M. Archer, III, Carmel, Calif.

[73] Assignee: Entropy Racing, Monterey, Calif.

[21] Appl. No.: 62,083

[22] Filed: May 14, 1993

Related U.S. Application Data

[63] Continuation-in-part of Ser. No. 755,927, Sep. 6, 1991, abandoned.

[51] Int. Cl.[5] ..... A42B 3/00

[52] U.S. Cl. ..... 2/411; 2/2; 2/410; 2/413; 2/425

[58] Field of Search ..... 2/2, 410, 411, 412, 2/413, 414, 415, 416, DIG. 3, DIG. 10, 421, 424, 425, 9; 280/728, 734, 735, 736, 737, 741

[56] References Cited

U.S. PATENT DOCUMENTS

| | | | |
|---|---|---|---|
| 3,855,631 | 12/1974 | Ettinger | 2/2 |
| 3,879,761 | 4/1975 | Bothwell | 2/415 |
| 3,921,944 | 11/1975 | Morrison | 2/2 |
| 4,059,852 | 11/1977 | Crane | 2/2 |
| 4,274,161 | 6/1981 | Littler | 2/413 |
| 4,324,005 | 4/1982 | Willis | 2/413 |
| 4,637,044 | 1/1987 | Taheri | 2/2 |
| 4,806,180 | 2/1989 | Goetz et al. | 280/741 |
| 4,817,828 | 4/1989 | Goetz et al. | 280/736 |
| 4,909,549 | 3/1990 | Poole et al. | 280/738 |
| 4,948,439 | 8/1990 | Poole et al. | 280/728 |
| 4,977,623 | 12/1990 | DeMarco | 2/2 |
| 4,984,821 | 1/1991 | Kim et al. | 280/728 |
| 5,016,914 | 5/1991 | Faigle et al. | 280/741 |
| 5,091,992 | 3/1992 | Pusic | 2/2 |

FOREIGN PATENT DOCUMENTS

| | | | |
|---|---|---|---|
| 043990 | 7/1980 | European Pat. Off. . | |
| 0043990 | 1/1982 | European Pat. Off. | 2/2 |
| 2717234 | 11/1978 | Fed. Rep. of Germany | 2/412 |
| 3142962 | 5/1983 | Fed. Rep. of Germany | 2/411 |
| 2499373 | 8/1982 | France | 2/DIG. 3 |
| 1348239 | 12/1972 | United Kingdom . | |
| 1519771 | 8/1978 | United Kingdom | 2/411 |
| WO93/07772 | 4/1993 | World Int. Prop. O. . | |

OTHER PUBLICATIONS

Article Entitled: "Dr. Archer's Air Bag", by Steven L. Thompson, Feb. 1989, At Large (1 page).

Article Entitled: "Helmet to Save Neck", Tech Update, Mar. 1993 (1 page).

Article Entitled: "Northern Comfort", Airbags for Race Cars, by Ro McGonegal, Jul. 1992 (3 pages).

International Search Report, International Application No. PCT/US92/10636 (3 pages).

Notification of Transmittal of the International Search Report or the Declaration, International Application No. P453PCT, International Application No. PCT/US92/10636, International Filing Date Sep. 4, 1992 (3 pages).

*Primary Examiner*—Clifford D. Crowder
*Assistant Examiner*—Gloria Hale
*Attorney, Agent, or Firm*—LaRiviere & Grubman

[57] ABSTRACT

Effective support of the head and neck during high impact accidents or rapid or sudden acceleration or deceleration of riders of motorcycles, skimobiles, jet skis and power boats, is provided by a cervical protection system having a gas-filled bag (110) rapidly deployable from a collar (105) disposed around the base of a helmet (101). When deployed, the bag (110) extends to the mid-sternal area anteriorly, to approximately the fourth or fifth thoracic vertebrae posteriorly, and laterally on the shoulders to a point approximately mid-way between the sternomastoid muscle group and the lateral tip of the scapula, and holds the wearer's head in slight extension to mitigate physical harm. Also, a deployable cervical collar which is removably mounted to a helmet. The collar deployable before or after impact.

20 Claims, 21 Drawing Sheets

A–A'

CERVICAL PROTECTION SYSTEM

This is a continuation-in-part application of prior and copending application, Ser. No. 07/755,927, filed Sep. 6, 1991, now abandoned.

TECHNICAL FIELD

This invention relates to protection and mitigation of head and upper spine injury owing to impact. In particular, the invention relates to a system for protecting the head and cervical spine of motorcycle riders, as well as drivers of power boats, jet skis, snow mobiles, and the like, when subjected to high speed crashes. The system of the present invention is also effective for protecting the head and cervical spine of pilots of private and military aircraft, especially, in the miliary application, when subject to the shock and stress loading encountered during ejection from disabled aircraft.

BACKGROUND ART

Injuries of the head and neck are among the most devastating suffered by human beings. Despite great advances in safety equipment, they remain a leading cause of death and disability in our society.

Since many, if not most of these injuries occur during adolescence and young adulthood, such events may be considered even more costly to society in terms of productivity lost and medical costs endured. Indeed, a recent article in *The Journal of the American Medical Association* cites the great cost to society of motorcycle injuries alone.

Improvements in the ability of protective headgear to insulate the skull and its contents from trauma seem to have reached a plateau. Changes in helmet design are now oriented more toward comfort and weight savings. While these changes seem appropriate, typically any blow severe enough to overwhelm a modern helmet's defense would probably produce devastating damage to the neck, or cervical spine. Therefore, a system to protect the cervical spine is the next step in the evolution of safety equipment. Only when a practical system for protecting the cervical spine is achieved will further improvement of head protection be worthwhile.

The cervical portion of the spine is somewhat unique in that it lacks the extensive supporting musculature of the rest of the vertebral column. As the skull is carried close to its center, and hence, supported against the pull of gravity, neck muscles are mainly designed to facilitate movement. The principle neck muscles are the sternomastoid, which flex and rotate the head, and the trapezius, which extends it.

FIG. 1 is an exploded view of human cervical vertebrae, comprising: posterior tubercle 10; groove for vertebral 11; anterior arch facet for dens 12; interior tubercle 13; inferior articular process 14; transverse process 15; superior articular facet 15; dens (odontoid process) 17; transverse process posterior tubercle 18; costo-transverse bar 19; anterior tubercle 20; path of the vertebral artery (blood supply) 21; foramen transversarium 22; spine 23; lip 24; articular process inferior 25 and superior 26; carotoid tubercle 27; vestigial anterior tubercle 28; body 29; lateral mass tubercle for transverse ligament 30; superior articular process 31; atlas 34; axis 35; third cervical vertebrae 36; fourth cervical vertebrae 37; fifth cervical vertebrae 38; sixth cervical vertebrae 39; and seventh cervical vertebrae 40.

FIG. 2 is a front view of human articulated cervical vertebrae. FIG. 2 comprises many of the elements of FIG. 1, and further includes transverse process anterior tubercle 41, and gutter for nerve 42. FIG. 3 is a side view of human articulated cervical vertebrae. FIG. 3 includes many of the elements of FIGS. 1 and 2, and further comprises: vertebral artery 43; spinous processes or spines 44; column of articular processes 45; and lamina 46.

FIG. 4 is a cut-away side view of the intervertebral disc and ligaments in humans. FIG. 4 includes some of the elements in FIGS. 1–3, and further comprises: anterior longitudinal ligament of the bodies of the vertebrae 47; posterior longitudinal ligament of the bodies of the vertebrae 48; ligamentum flavum 49; interspinous ligament 50; supraspinous ligament 51; bursa 52; nucleus pulposus 53; intervertebral discs 54; cavity for nucleus pulposus 55; annulus fibrosus 56; hyaline plate 57; nucleus pulposus protruding into bodies 58; canal for basivertebral vein 59; ventral and dorsal nerve roots 60; and dura mater 61.

Referring to FIGS. 1–4 cervical vertebrae can be visualized as two short, adjoining cylinders, the larger of which is the vertebral body. This is the load-bearing structure of the spinal column. Cervical vertebrae are solid and separated from adjacent members by resilient fibrocartilaginous structures called intervertebral discs.

The spinal cord is carried in the adjacent, hollow cylinder formed by the laminae (arch) in a space known as the spinal foramen. The blood supply to the spinal cord, the vertebral artery, is carried in holes through bony projection lateral to the vertebral bodies. Additionally, there is a bony projection posteriorly from the arch called the spinous process. Ligaments connect these and the other structures, contributing to the strength of this system.

The areas of the spinal column most often affected by injury are the fourth and fifth cervical vertebrae, and the eleventh and twelfth thoracic. In the latter, the intrinsic strength of muscle groups in the area provide considerable support. The cervical spine, as previously noted, has little muscle support. Therefore, the considerable mass of the head acts as a pendulum or dead weight during impact to or sudden movement of the body.

In instances of spinal cord trauma, rapid and excessive movement and/or compression of the cervical spine occurs, tearing intervertebral ligaments, compressing and rupturing discs and vertebral bodies. The spinal cord, trapped in the spinal foramen, may be compressed by bone fragments or an extruded disc, or it may be stretched, interrupting its blood supply or tearing its nerves. In a series of cervical spine injuries studied by Bohlman and Boada, described in their work *Fractures and Dislocations of the Lower Cervical Spine*, one third of such injuries were due to motor vehicle accidents; their incidence is highest in adolescents and young adults.

Disc injuries were found to be most common. Brain injuries associated with spinal cord lesions in 61% of cases and the spinal cord lesions with brain injuries in 63% of cases, indicate the close association of cord injuries with head trauma. In very few cases was total spinal cord disruption noted. Instead, significant nerve damage was found to be primarily due to ischemia (interruption of the blood supply), and was improved most by early stabilization and reduction.

Immobilization should be carried out as soon as possible after a cervical spine injury is recognized since continuous movement may accentuate the pathologic processes that are already underway within the spinal cord as a result of the injury. Thus, often a soft collar with spinal traction is recommended as soon as possible after trauma.

The most common forces causing spinal cord injury are:

1) Flexion
2) Flexion rotation
3) Vertical (axial) loading with slight flexion
4) Extension.

1) Flexion

Straight flexion injury is by far, the most common injury in the cervical spine, often together with crumbling of a large portion of the superior anterior portion of the lower vertebrae, and also involving tearing of the ligaments between vertebral processes and stretching the spinal cord, as shown in FIGS. 5 and 6. There is interruption of the blood supply to the tissues, microscopic hemorrhage, and swelling. Since the swelling occurs in a confined space, increased pressure further impairs the blood supply and further tissue damage ensues.

2) Flexion rotation

The head is turned at the time of flexion resulting in unilateral ligamentous and bone injury and tissue injury similar to those in pure flexion.

3) Vertical or axial loading with slight flexion

In this instance, with reference to FIGS. 7–11, the vertebral body may be crushed and squeezed into the spinal foramen. This causes damage to the spinal cord both by direct pressure and indirectly by impairing its blood supply. The vertebral disc may be extruded into the foramen with similar results.

FIG. 11 shows an interior wedge fracture. In FIG. 8, crushing of the whole body is shown. FIG. 9 shows a posterior fragment of the vertebrae pushing out against the spinal cord. Finally, in FIG. 10, final displacement with a crushed body in flexion with posterior displacement of the vertebral body fragments is shown.

4) Extension

In cervical cord hyperextension injury 62, intervertebral ligaments and discs are torn as shown in FIG. 12. Spinous processes are jammed together and fractured at the base, decreasing the cervical spine's resistance to flexion injury and spinal cord 63 stretching as the head rotates forward in reaction. Flexion-extension injuries are the type most commonly occurring in automobile accidents.

Plainly, some sort of support system used in conjunction with a helmet is required to prevent or lessen the severity of these injuries. Currently, the only devices available are of the fixed type, usually consisting of a fabric-covered resilient foam collar between the helmet and shoulders. This design has gained wide acceptance in automotive racing but has some distinct drawbacks, as discussed elsewhere in this specification.

Note that there is virtually no use of such devices among motorcyclists and pilots. The restriction of head mobility that "collars" produce is typically unacceptable to them. Unfortunately, however, such people are at significant risk for spinal cord trauma. Even though a number of safety and protective devices are provided for pilots of military and private aircraft, there is no system for restricting head mobility at impact of a crash or during ejection from disabled aircraft.

Other disadvantages with fixed devices go beyond their limited acceptance. Rotational and flexion-extension injuries are the most prevalent in auto accidents. Current designs do not provide significant protection against extreme flexion, and the limited areas of contact with that helmet may actually provide a fulcrum, raising the center of rotation and increasing traction forces on the spinal cord and exacerbating injury.

The prior art includes U.S. Pat. No. 3,900,896, which relates to a neck brace for athletes, such as football players, for protecting the athlete from possible neck fractures or spinal cord injuries. The neck brace described generally comprises a rigid member vertically disposed immediately posterior and parallel to the neck of the athlete, with the upper end secured to the protective helmet and the lower end supported on a bracket constituting a part of the suit or shoulder pad of the athlete. While coupling of the rigid member and the lower bracket is described as providing for free rotation of the member around a vertical axis generally parallel to the neck, the amount of actual free rotation is uncertain. In addition, this invention unequivocally teaches limited forward and backward tilting of the head. Finally, to the obvious discomfort of the wearer, the neck brace must be used with a lower supporting member. The restriction of head mobility is simply unacceptable to most sports participants, including motorcyclists and drivers of other similar vehicles such as power boats, jet skis, snow mobiles and the like.

In U.S. Pat. No. 3,930,667, an inflatable garment for crash protection to be worn by a motorcycle rider is described. The garment is detachably connected to a source of pressurized gas operative to inflate the suit in response to a predetermined deceleration of the motorcycle or manual operation when a crash or spill appears inevitable. The source of pressurized gas is disposed on the motorcycle. Thus, if the rider jumps or is thrown from the motorcycle before the garment or suit is fully inflated, protection for the rider from the first or multiple impacts thereafter is compromised. Moreover, while the garment or suit described may be effective for protecting the back and spine, it appears to be ineffective for protecting the cervical portion of the spine or the head of the rider.

Finally, U.S. Pat. No. 4,825,469 also teaches motorcycle safety apparel, which in the event of an impending or actual accident will inflate to provide a protective enclosure for parts of the body most susceptible to critical or fatal injury. However, again the source of compressed or liquified gas is disposed on the motorcycle which compromises the overall effectiveness of the garment in the same way discussed with respect to U.S. Pat. No. 3,930,667. Several different embodiments of the safety apparel are described and typically include an inflatable hood which expands upward and then forward around the top and sides of the head. However, it is uncertain that flexion and flexion rotation injuries are prevented upon impact, or that damage from axial loading or extension injuries are even reduced.

At any early stage in the development of the present invention, an article was published regarding the present invention. See, Thompson, Steven L., "Dr. Archer's Air Bag", *Cycle World*, February 1989 issue.

DISCLOSURE OF INVENTION

Ideally, a system for preventing excessive movement of the head and the resulting cervical spine damage should be present only when desired and not before.

Only then could significant use by motorcyclists, or others, be expected. In addition, such a system should be designed to provide superior protection to current designs without limiting head mobility. Therefore, according to the above-described mechanisms of injury to the cervical spine, the cervical protection system of the present invention teaches:

1) Effective limitation of the speed and extent of head movement;

2) Rapid, timely and complete deployment;

3) Comfort in undeployed form to maximize use;

4) Sustained support after initial deployment to minimize subsequent movement and further injury; and 5) Light weight and low center of mass to minimize forces acting on the head and neck.

A cervical protection system constructed according to the principles of the present invention provides effective support of the head and neck by a gas-filled bag deployable from a hollow collar that is disposed around the base of an impact-resistant helmet. In deployed configuration, the bag may extend to approximately the mid-sternal area in front, to approximately at least the seventh cervical vertebrae or further to the fourth or fifth thoracic vertebrae behind, and laterally on the shoulders to a point approximately midway between the sternomastoid muscle group and the lateral tip of the scapula. These dimensions should effectively limit flexion-extension and rotation about a horizontal axis. In addition, the anterior and posterior contour of the deployed bag is as wide as possible at its base to help prevent rotation about a vertical axis.

Deployment is produced by filling the collapsed bag with gas under pressure. The source of gas may be provided by a pressurized capsule or other chemical agents. The charge container should be easily accessible so that the bag may be deflated by its removal.

Replaceable capsules would thread into a sealed system so that pressure in the bag is maintained after deployment. The capsule and coupling device may have a wide opening to allow the quickest possible release of its charge into the bag. Also, the opening in the capsule may be narrow for relatively slow increase in bag inflation. The width of the opening depending upon the required application.

Bag deployment is initiated by breaking the capsule's seal by a spring-driven piercing mechanism that allows charge escape. Similarly, systems for rapidly initiating chemical reactions for producing gas with which to fill the bag may also be used.

The discharge mechanism itself could be activated in a variety of ways. A purely mechanical version might use a simple pull-pin to release the spring-loaded piercing device. In the case of motorcycle riders, the pull-pin could be attached to the vehicle by a cable so that the system would be activated if the rider became separated from his machine. A more sophisticated and expensive system uses accelerometers to initiate deployment of the bag when head and/or body acceleration exceeded some predetermined rate.

Ideally, the bag in collapsed form fits in the chin-bar and neck roll region of the helmet, extending slightly below it. In this way, normal head movement is unrestricted while wearing the helmet.

Realistically, it is probably not possible to protect against vertical impact and axial loading with the present invention. Studies show injuries to the spinal cord from axial loading seem to be produced primarily from the extrusion of the inter-vertebral discs or the remnants of crushed vertebral bodies into the spinal foramen. Since this type of damage occurs only if the impact happens while the cervical spine is in flexion, it is desirable to design the system of the present invention so that the head is held in a slight extension by the deployed bag to mitigate the damage caused by axial loading. This position is also best for maintaining airway patency. Ideally, the deployed bag should maintain the head in slight extension. This may be accomplished through having the deployed bag extend under the lower jaw in the front, or under the occipital area (i.e., in the nape of the neck) behind, or both.

As stated above, realistically, it may not be possible to protect against some forms of impact and loading. Therefore, in an alternate embodiment of the present invention in the form of a portable, deployable cervical collar is provided. The deployable cervical collar can be used for either pre-impact or post-impact. As the deployable cervical collar may be deployed after impact, the medical benefits for maintaining the head and neck as described above, can be achieved. Specifically, maintaining the head in slight extension is provided with the instant cervical collar.

Also, once the head and neck are stabilized with the deployed bag, it may be desirable to remove the helmet for further treatment, e.g., providing a mouth-to-mouth resuscitation treatment. Prior to the present invention, at least two people were required to remove a helmet. One person to stabilize the head and neck while the other removed the helmet. Or, in the case of a portable cervical collar, one person could first employ the portable cervical collar and then remove the helmet. However, since most people do not carry around such portable cervical collars, the present invention provides a deployable cervical collar which is detachable from a helmet.

The weight of the bag and its deployment mechanism's must be minimal, and their location at the base of the helmet minimizes the polar moment of the head and neck. In particular, the mechanism should be located at the back of the helmet, as in the preferred embodiment, to minimize polar movement. For motorcycle riders, the bag must be constructed of an abrasion-resistant material.

Other features of the present invention are disclosed or apparent in the section entitled "BEST MODE FOR CARRYING OUT THE INVENTION".

BRIEF DESCRIPTION OF DRAWINGS

For fuller understanding of the present invention, reference is made to the accompanying drawing in the following detailed Description of the Preferred Embodiment of the invention. In the drawing.

Figure 1:
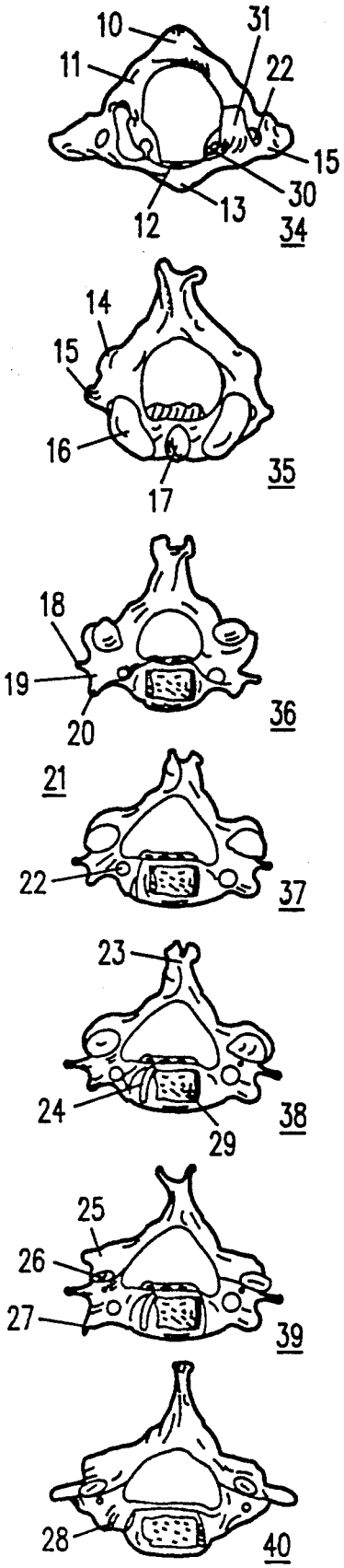
FIG. 1 is an exploded view of cervical vertebrae in humans.
Figure 2:
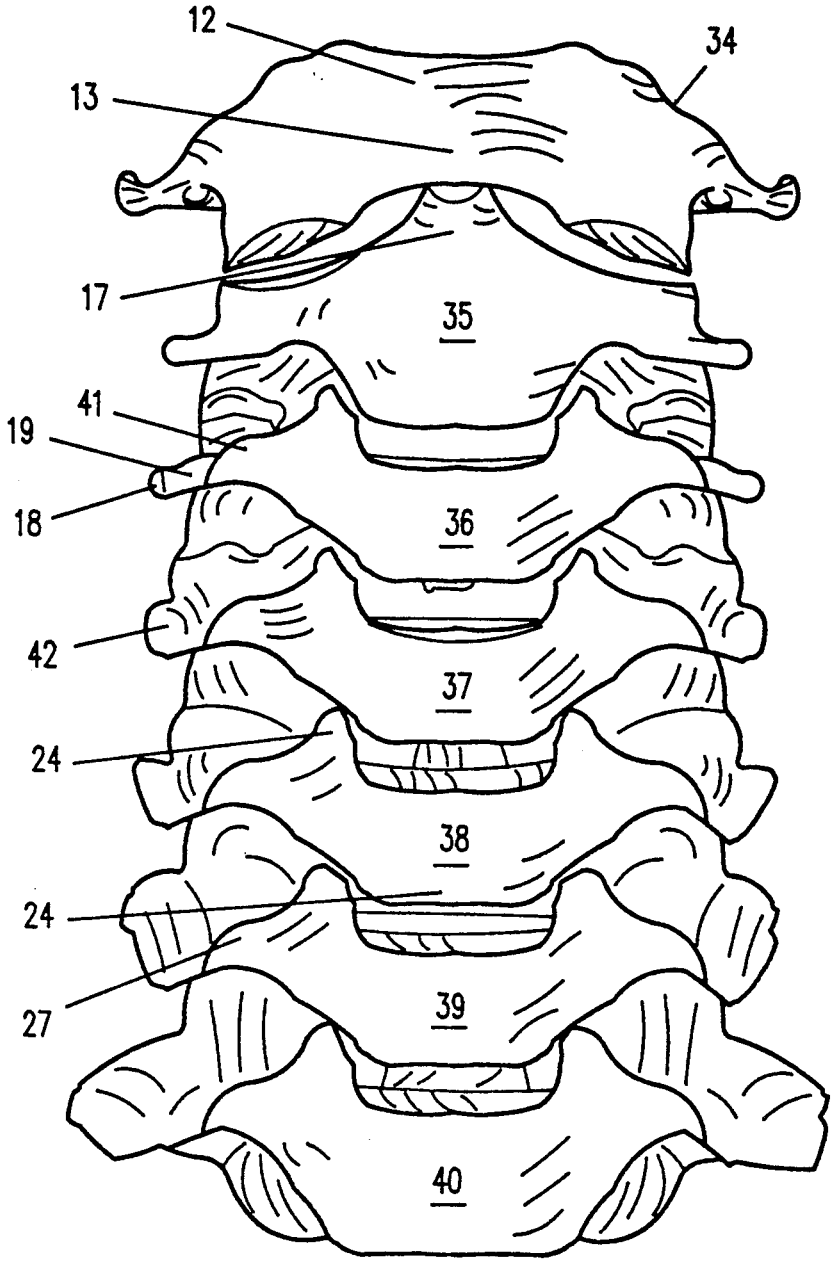
FIGS. 2 and 3 are the front and side views, respectively, of articulated cervical vertebrae in humans.
Figure 3:
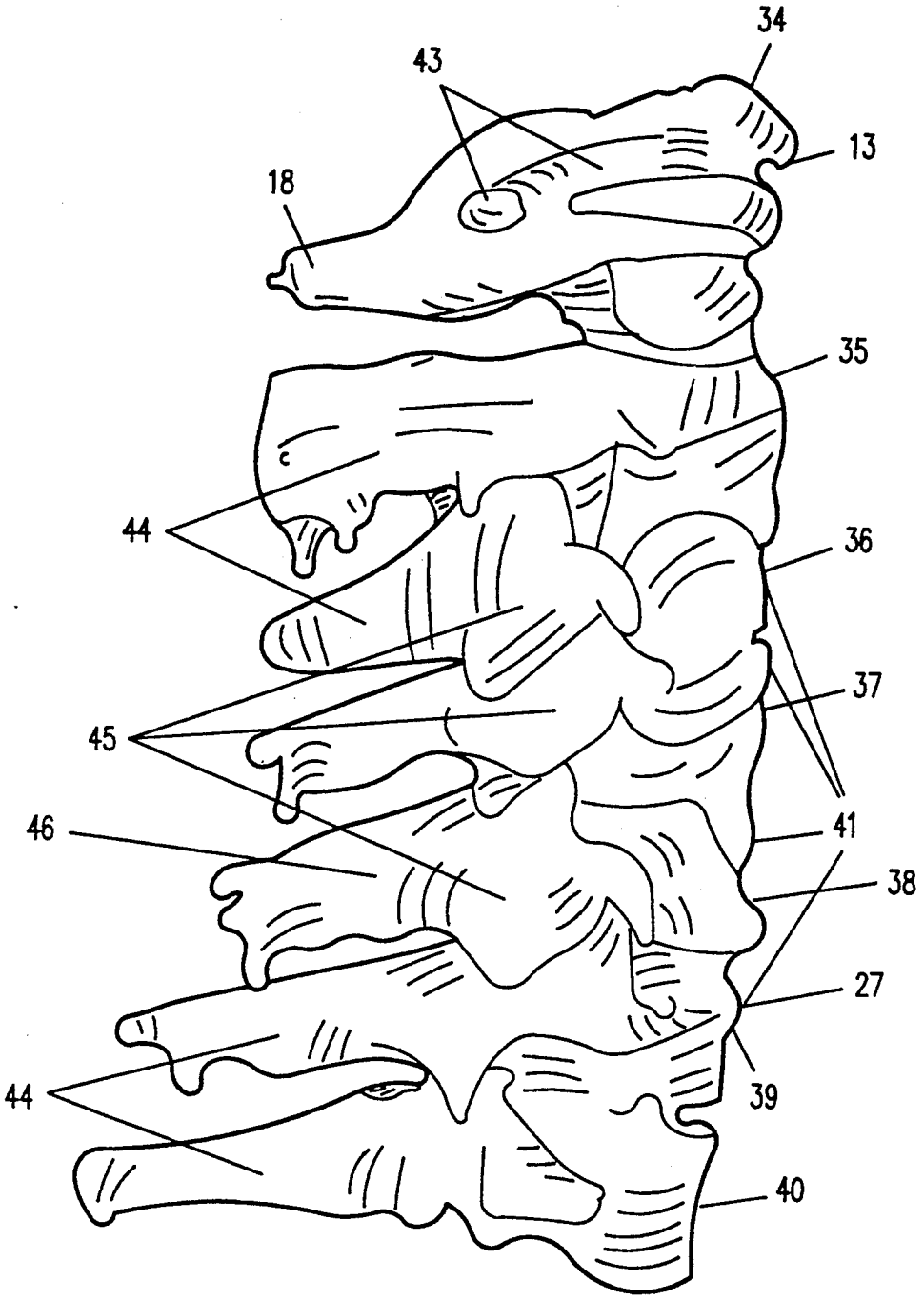
Figure 4:
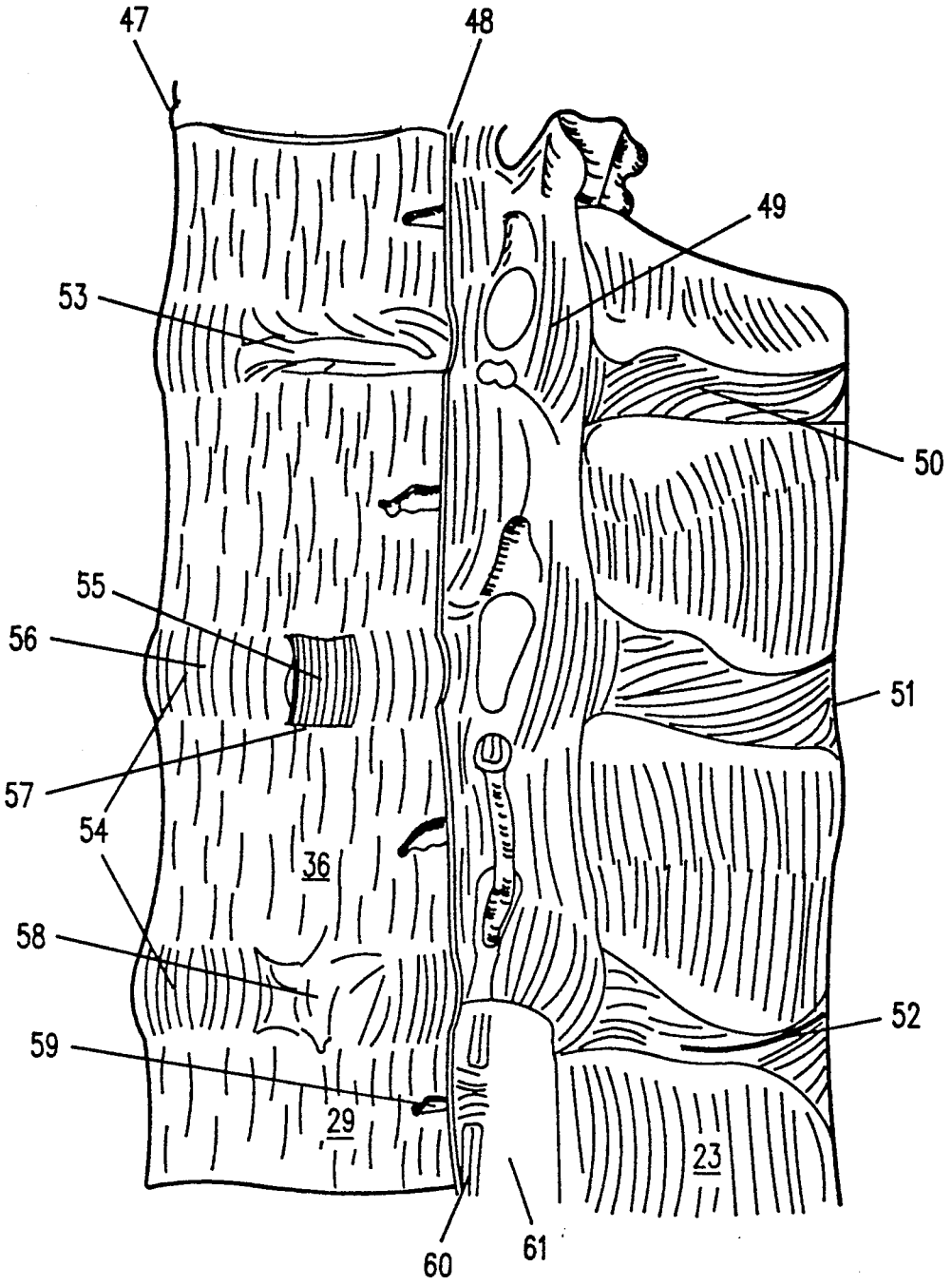
FIG. 4 is a cut-away side view of the intervertebral disc and ligaments in humans.
Figure 5:
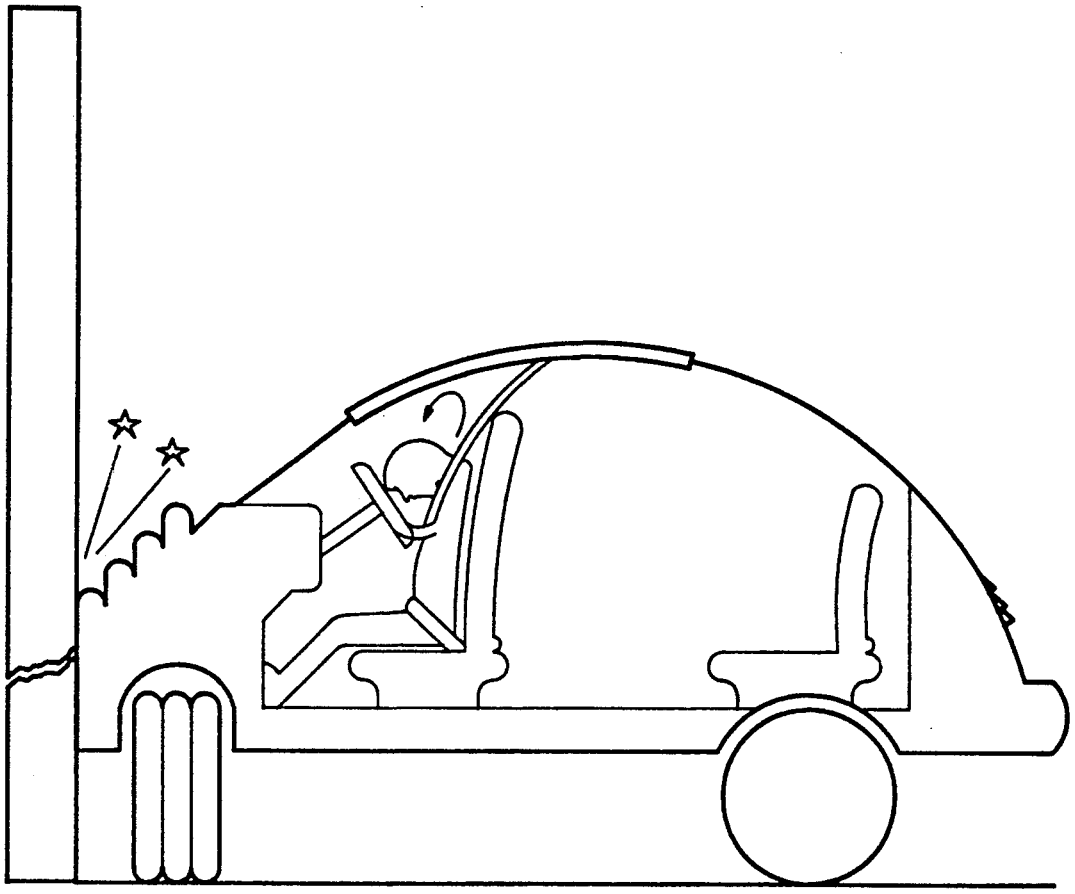
FIG. 5 illustrates mechanisms of flexion injury in humans.
Figure 6:
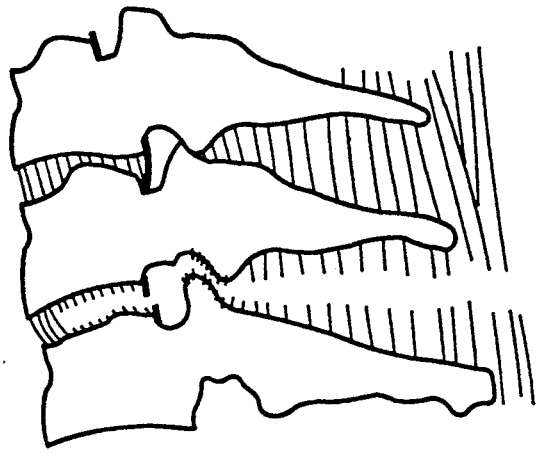
FIG. 6 is a cut-away side view showing flexion injury with gradual posterior tearing, posterior joint subluxation, posterior longitudinal ligament tearing and eventual disc disruption.
Figure 7:
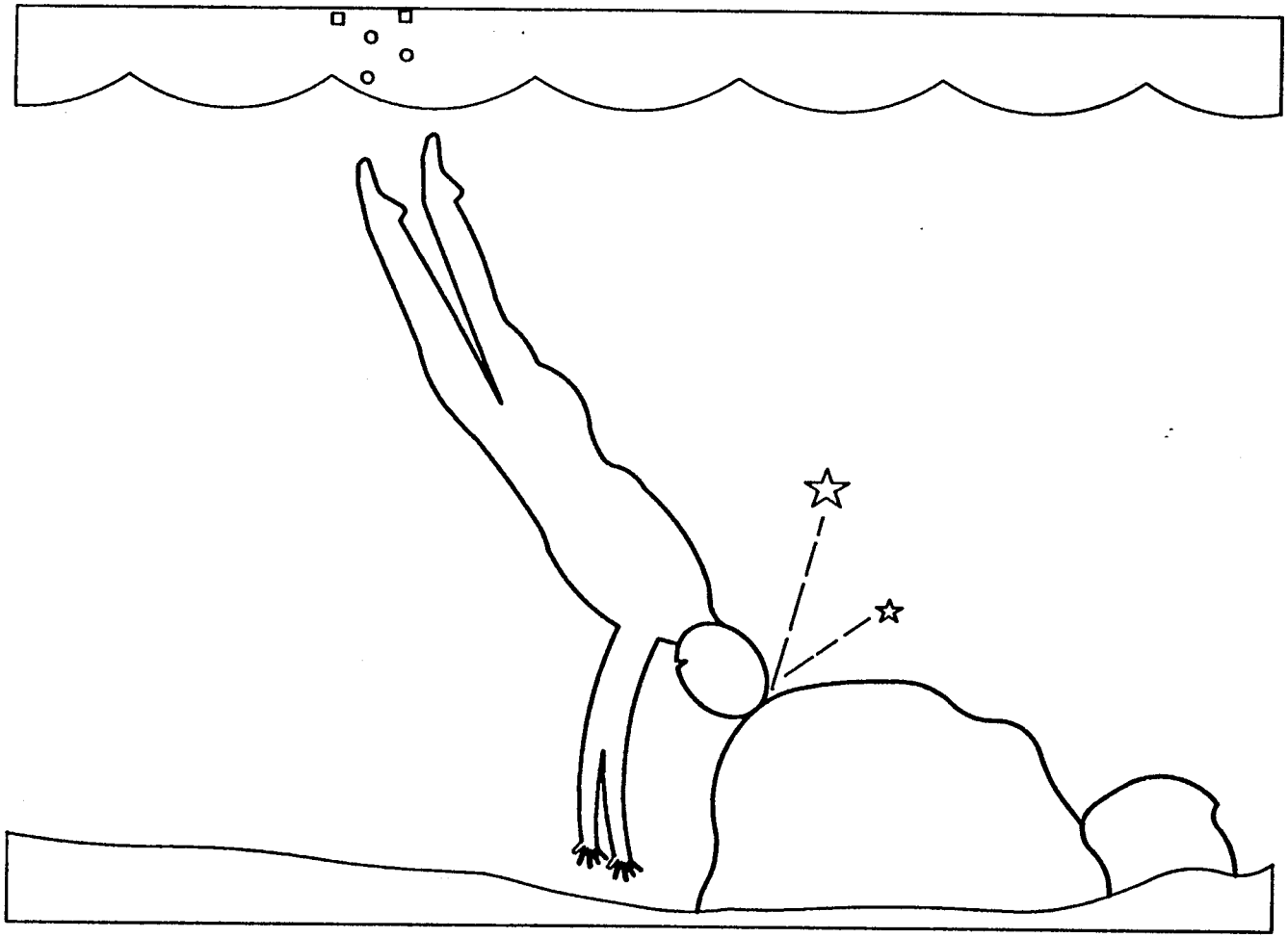
FIG. 7 illustrates mechanisms of a burst fracture (vertical axial loading).
Figure 10:
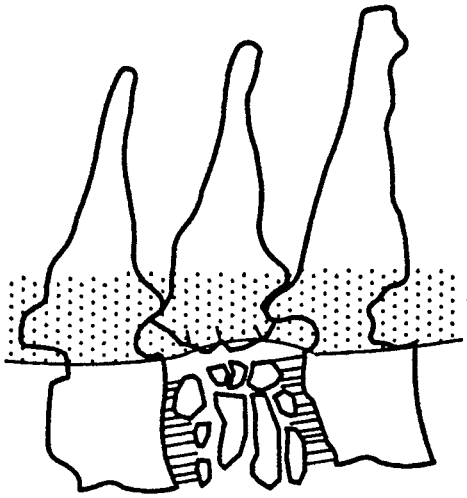
FIGS. 8–11 illustrate the progression of the vertical loading and slight flexion injury.
Figure 11:
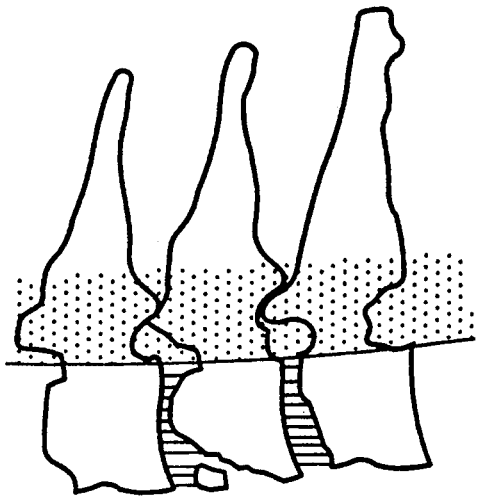
Figure 8:
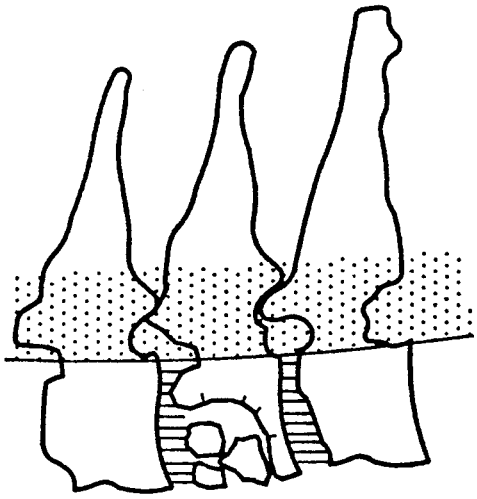
Figure 9:
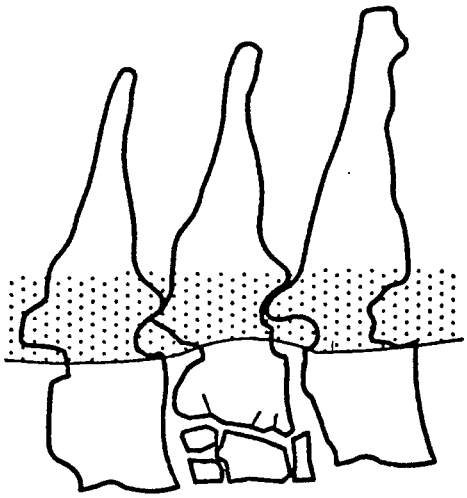
Figure 12:
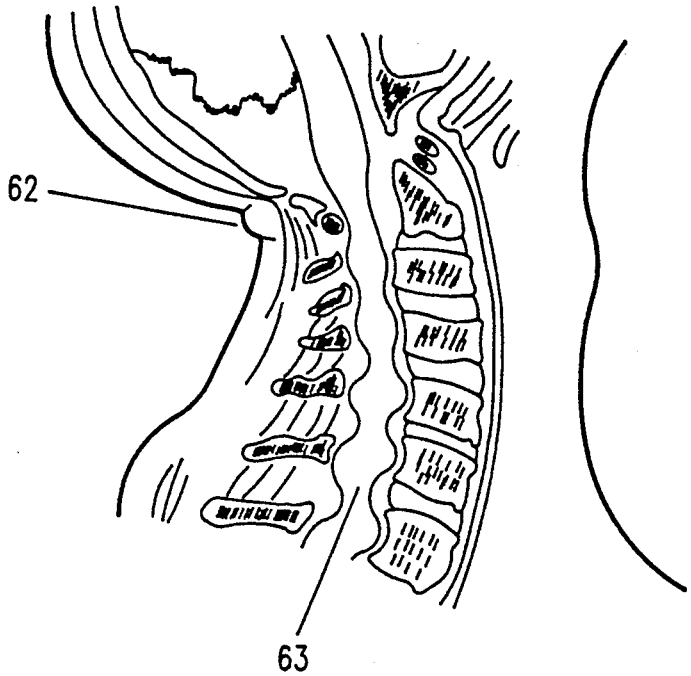
FIG. 12 illustrates hyperextension injury of the cervical cord in humans.

Reference numbers refers to the same or equivalent parts of the present invention throughout the several figures of the drawing.

BEST MODE FOR CARRYING OUT THE INVENTION

Figure 13:
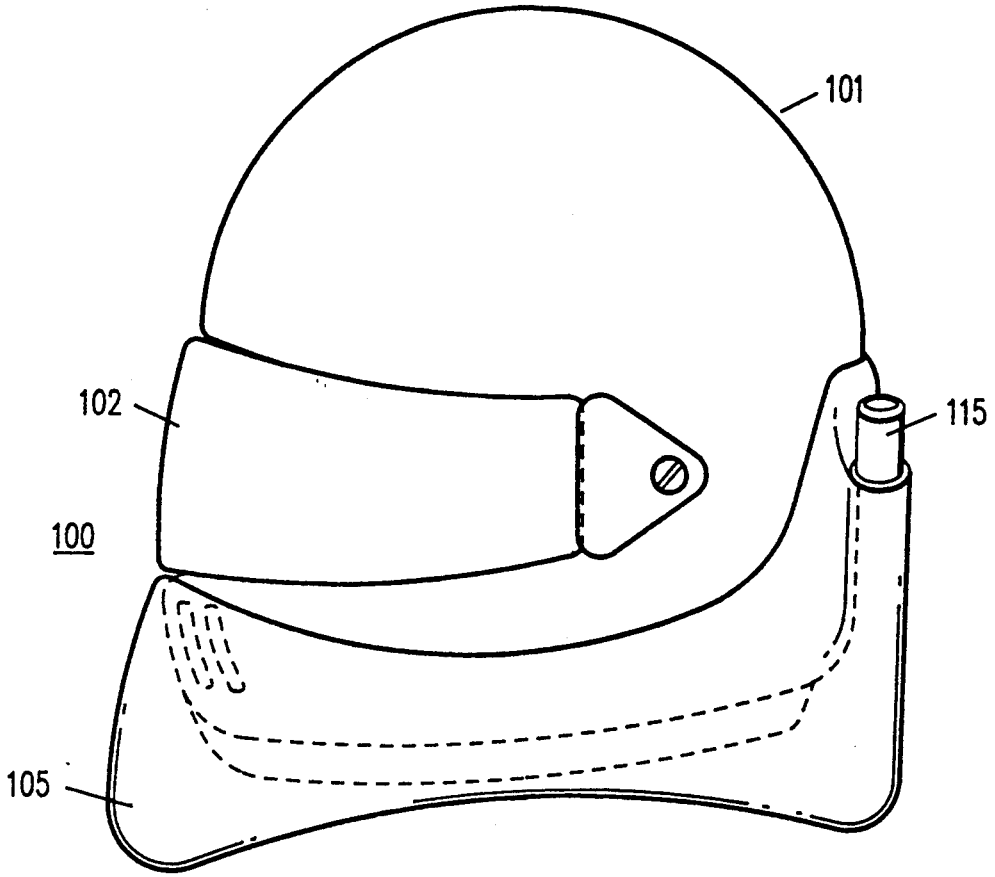
FIG. 13 is a side view of a cervical protection system constructed to the principles of the present invention.

Referring now to FIG. 13, cervical protection system 100 constructed according to the principles of the present invention comprise impact-resistant helmet 101 having visor 102 and hollow collar 105 for housing air bag 110 (not shown). Gas capsule 115 is mounted at the rear of helmet 101 and is coupled to air bag 110 via a gas release and flow control coupler (not shown).

Figure 14:
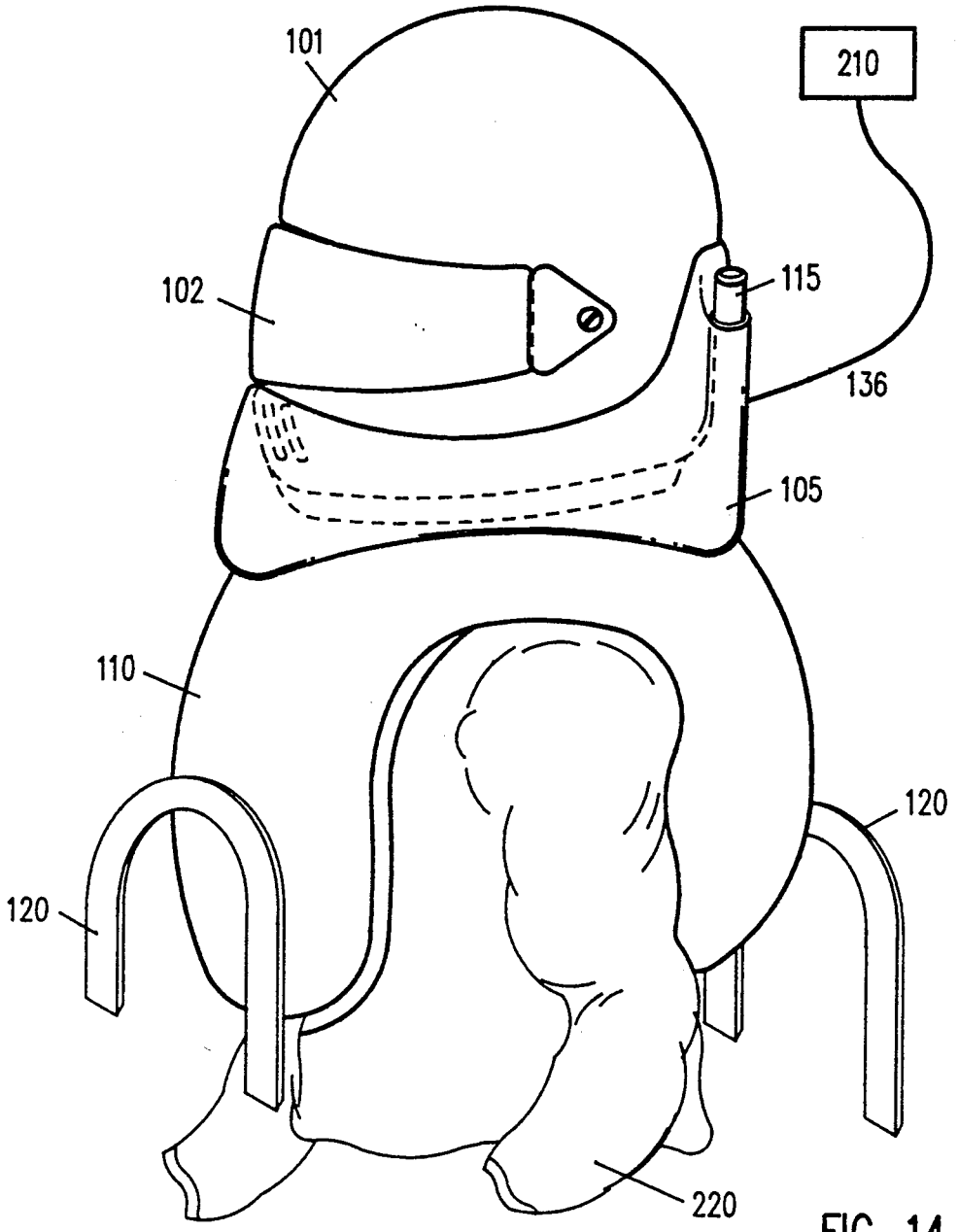
FIG. 14 is a perspective view of the cervical protection system of FIG. 13 with the air bag fully deployed.

Referring now to FIG. 14, air bag 110 is shown fully deployed from collar 105. The anterior portion of air bag 110 extends to the mid-sternal area of the wearer. The posterior portion of air bag 110 extends to approximately the fourth or fifth thoracic vertebrae of the wearer. Air bag 110 also extends over the shoulder to a point approximately midway between the sternomastoid muscle group and the lateral tip of the scapula. Flexible seal 120, attached to the outer surface of deployed air bag 110 is used to repack and seal air bag 110 into collar 105 when deflated as described elsewhere in this specification. Flexible seal 120 is sewn or glued, or is otherwise suitably attached to, the outer surface of air bag 110.

Figure 15:
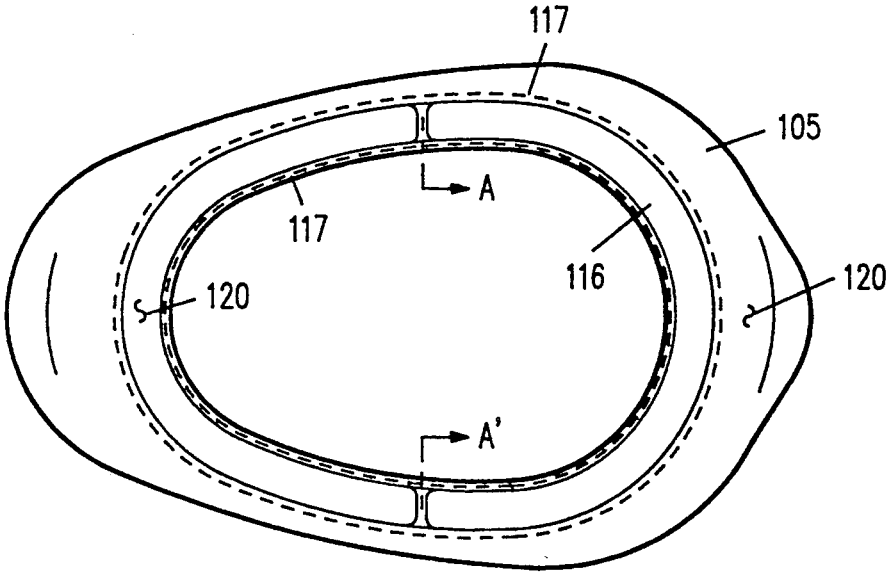
FIG. 15 is a bottom view of the cervical protection system of FIG. 13.

FIG. 15 is a bottom view of cervical protection system 100 which illustrates the assembly of flexible seal 120 into hollow collar 105. Hollow collar 105 includes an elongated opening 116 which conforms generally to the bottom periphery of hollow collar 105. Flexible seal 120 actually comprises two half moon or horseshoe shaped strips, the ends of which abutting at points A and A' and diametrically opposed from one another along the bottom periphery of hollow collar 105.

Figure 16:
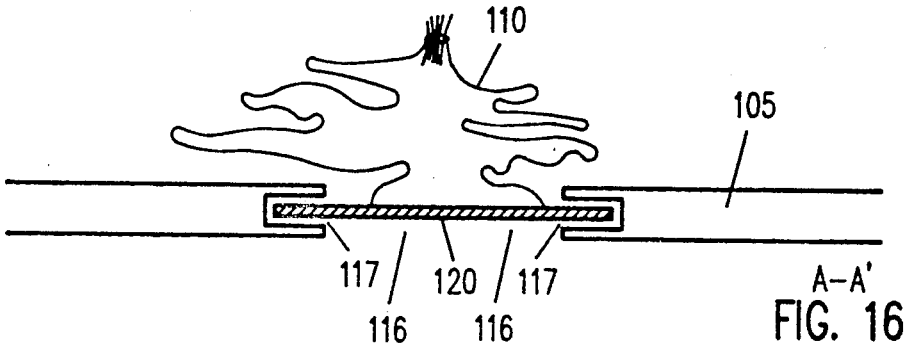
FIG. 16 is a cross-sectional view of the containment for the undeployed bag in the cervical protection system of FIG. 13 along A—A'.

As shown in FIG. 16, the bottom periphery of hollow collar 105 incorporates channels 117 formed in the opposing edges of elongated opening 116 of hollow collar 105 for receiving each half of flexible seal 120. As gas fills air bag 110, flexible seal 120 disengages from channels 117 in hollow collar 105 to facilitate rapid deployment of air bag 110. Assuming no damage to air bag 110 after deployment, flexible seal 120 may be reinstalled in channels 117 for repacking deflated air bag 110 into hollow collar 105 for reuse.

Figure 17:
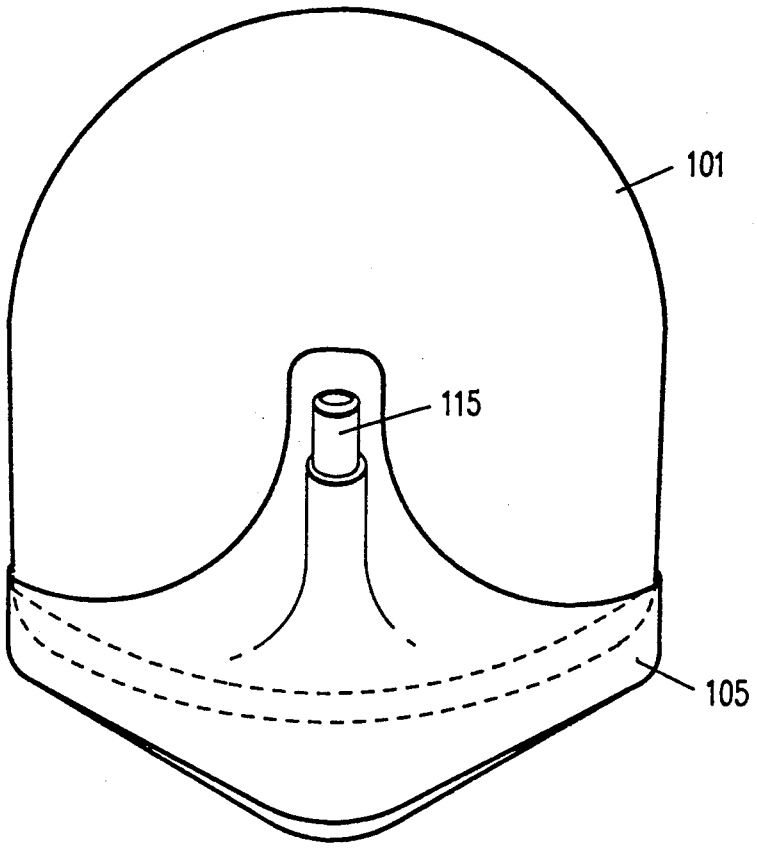
FIGS. 17 and 18 are back and front views, respectively, of the cervical protection system of FIG. 13.
Figure 18:
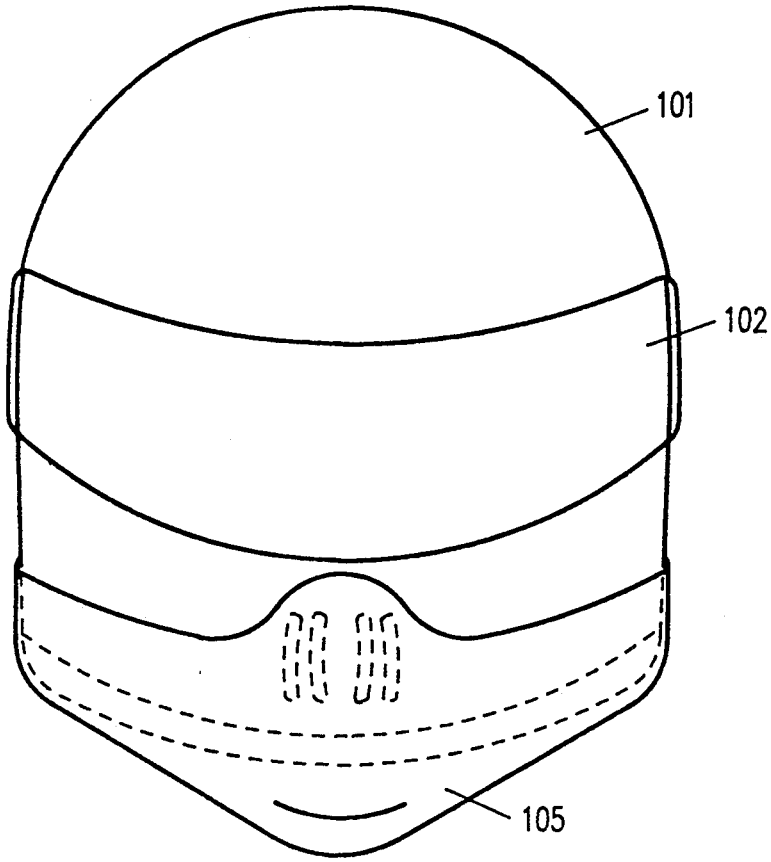

Referring now to FIGS. 17 and 18, gas capsule 115 is mounted at the rear of helmet 101, together with a gas release and flow control coupler (not shown). Gas capsule 115 may contain either compressed gas, such as $CO_2$ or the like, or may contain chemical agents for producing gases when intermixed by the coupler mechanism for explosively initiating deployment of air bag 110. Well-known chemical agents such as sodium azide or zirconium potassium perchlorate produce gases of the type required for this application. Other similar discharge mechanisms which are common in onboard fire retardant systems currently used in automotive racing may also be used. Of course, a smaller size is required in this application.

Impact resistant helmet 101 may be of standard configuration and construction conforming to the highest standards of the industry for providing maximum structural integrity and protection to the wearer during single and multiple impact accidents. Such helmets are manufactured by Bell, Showei and Arai. Such helmets typically include visor 102 and a chin strap (not shown).

Collar 105, flexible seal 120 and air bag 110 are constructed of abrasion resistant flexible material such as Kevlar, manufactured by Dupont, or the like. It should be noted that the upper portion of hollow collar 105 also may be part of the molded outer shell of helmet 101 such that both can be manufactured into one molded form, and incorporate a bottom periphery constructed of flexible material to receive deflated air bag 110 and flexible seal 120.

It should be clear that the cervical protection system of the present invention may be designed and constructed as an integral part of impact resistant helmets or as a retro-fit kit for attachment to already existing helmets. Thus, hollow collar 105 including gas capsule 115, may be rigidly mounted to helmet 101 to facilitate retro-fit to helmets already being used by motorcycle riders, drivers of other vehicles, or any application where the body and the head of the wearer of the helmet are exposed to the risk of high speed, high impact accidents.

Figure 19:
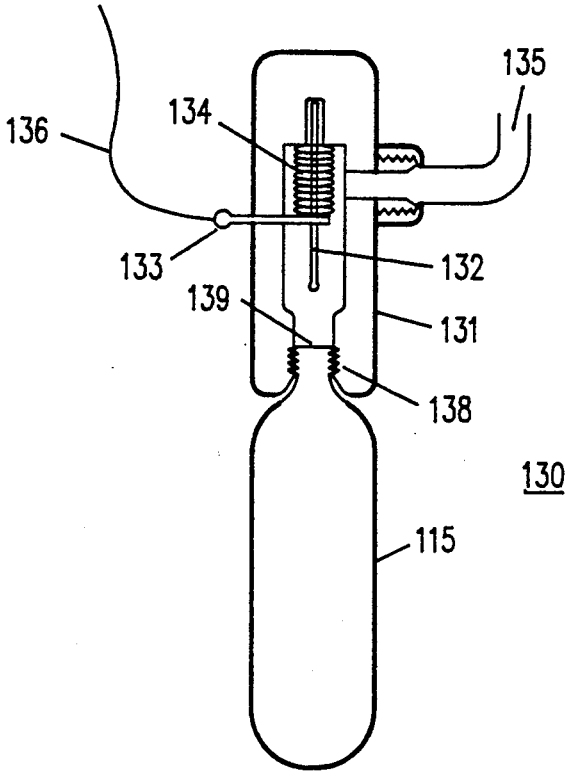
FIGS. 19 and 20 are cross-sectional views of the initiator system for the cervical protection system of FIG. 13.

Referring now to FIG. 19, explosive initiator 130 includes housing 131, actuator 132, prior restraint 134, spring 134, tube 135 and tether 136. Housing 131 includes threaded portion 138 for receiving gas capsule 115 and for controlling flow of gas therefrom into air bag 110. Gas capsule 115 is a self-contained capsule, not unlike a $CO_2$ cartridge, having breakable seal 139 for explosively discharging its contents, whether compressed gas or gas produced by chemical agents.

Figure 20:
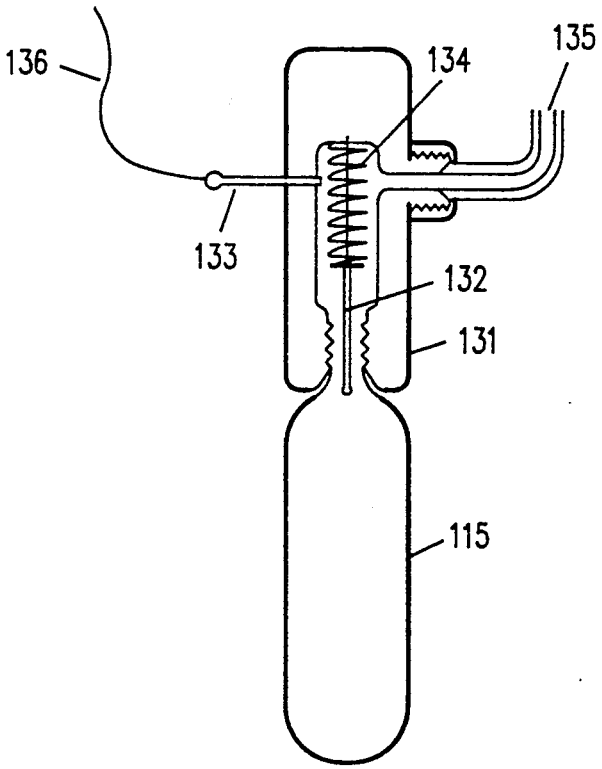

With reference to FIG. 20, actuator 132 breaks seal 139 of gas capsule 115 when activated by tether 136 which pulls pin 133 as the wearer becomes separated from the vehicle in or on which the wearer is riding. Actuator 132 also may be activated by a system of one or more accelerometer sensors when acceleration of the wearers head exceeds a predetermined rate or exceeds a predetermined rate with respect to the wearer's body or the vehicle in which or on which the wearer is riding. It should also be noted that deflation of air bag 110 is initiated by merely removing gas capsule 115.

The design of hollow collar 105, gas capsule 115 and explosive initiator 130 must be compatible with light weight and low center of mass of the overall cervical protection system to minimize forces acting on the head and neck. Additionally, rapid deployment is required for protection during impact. Thus, prior to impact bag 110 may be inflated, where the opening created in gas capsule 115 is as wide as possible.

Referring to FIG. 14, wearer 220 is shown attached to vehicle 210. Vehicle 210 forms no part of the present invention. Wearer 220 is wearing helmet 101 having hollow collar 105. Hollow collar 105 is coupled to vehicle 210 via tether 136 and pin 133 as shown in FIG. 20. When helmet 101 becomes separated from vehicle 210 by a distance greater than the length of tether 136, pin 133 is uncoupled from hollow collar 105, activating actuator 132. Thus, air bag 110 is subsequently inflated to deploy as described elsewhere in this specification for significantly limiting excessive movement of the head of wearer 220.

Figure 21:
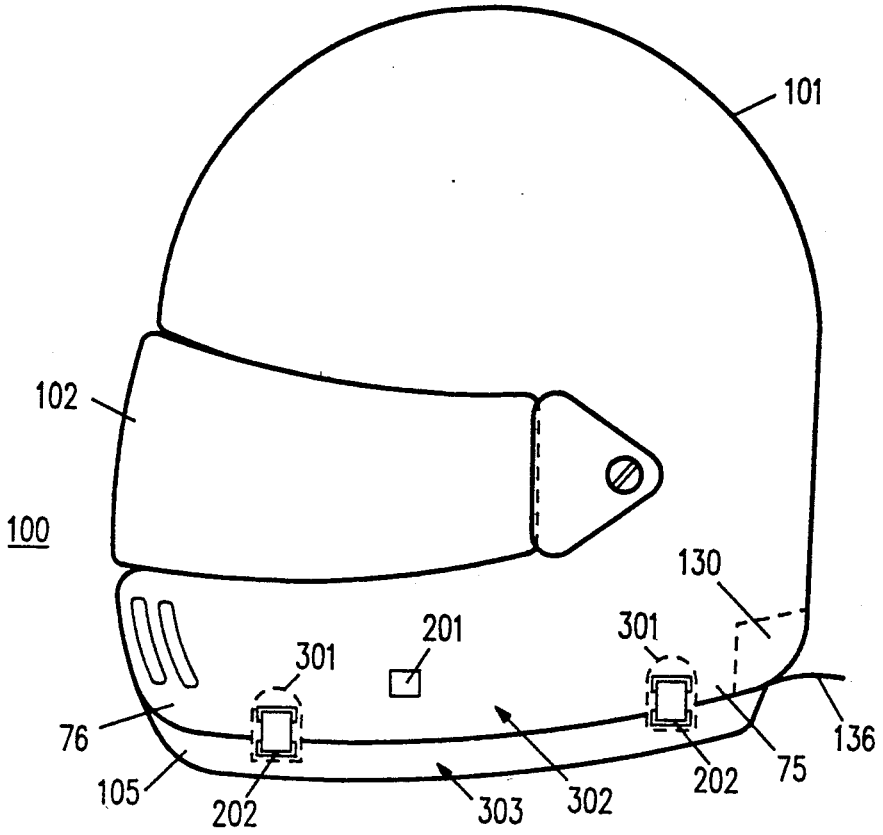
FIG. 21 shows a first alternate embodiment of the present invention providing a deployable cervical collar.

Referring now to FIG. 21, a first alternate embodiment of the present invention is shown. As shown, cervical protection system 100 comprises helmet 101 having visor 102, hollow collar 105, tether 136, initiator 130, clips 202 and chin-strap release 201. Clips 202 can be any of those well-known in the art of the present invention. Such clips are typically found on bindings for skis. However, any of a variety of well-known clips which can be released may be used with the present invention. Clips 202 may be recessed 301 into helmet 101 and collar 105 such that a clip 202 are substantially flush with the outer surface 302 of helmet 101 and outer surface 305 of collar 105. Moreover, outer surfaces 302 and 303 may be substantially flush to one and other. The flushness of the surfaces reduces the risk of catching, e.g., on pavement, and thus reduces the risk of additional torsional forces. It should be understood that clips 201 allow hollow collar 105 to be removably attached to helmet 101. Hollow collar 105 is removably attached to helmet 101 under the chin bar region 76 and neck roll region 75 of the helmet.

Figure 22:
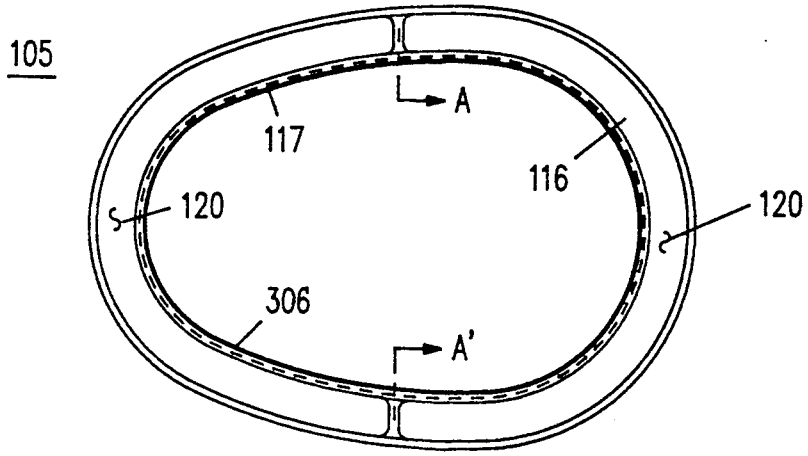
FIG. 22 shows a bottom view of the deployable cervical collar of FIG. 21.

FIG. 22 is a bottom view of collar 105. As shown, collar 105 comprises channel 117, opening 116 and flexible seal 120. Channel 117 allows flexible seals 120 to be located in opening 116 in a semi-fixed manner. Additionally, more than one channel 117 may be used. Moreover, a tacky-type adhesive may be used to quasi-secure flexible seals 120 to collar 105 without using any channel(s). As explained elsewhere in this specification, flexible seals 120 are disengaged from hollow collar 105 when bag 110 is deployed.

Figure 23:
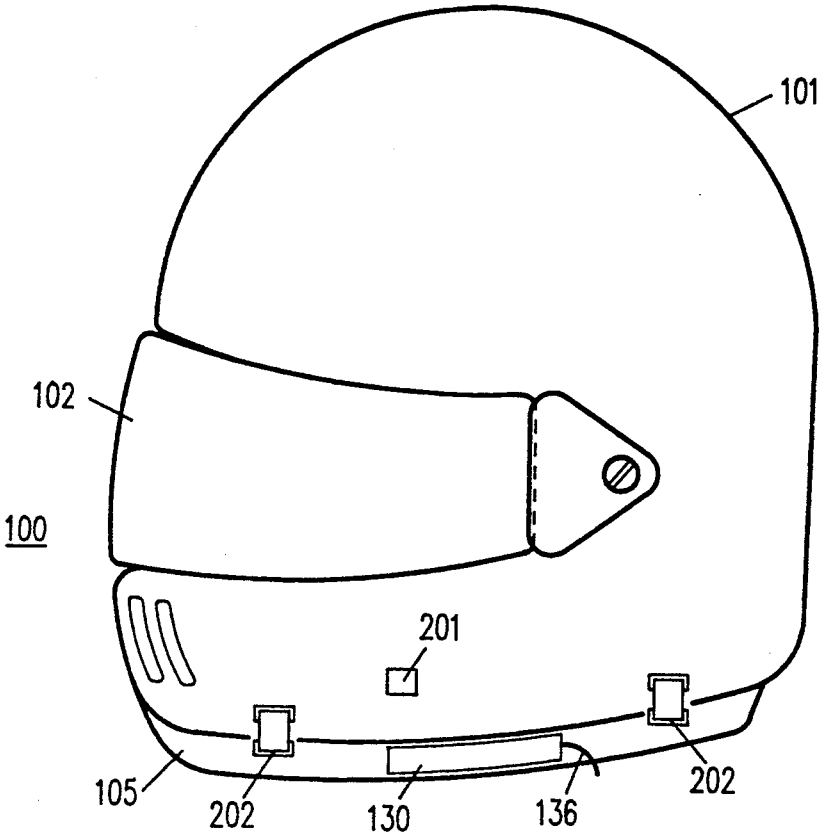
FIG. 23 shows a second alternate embodiment of the present invention providing an a deployable cervical collar.

Referring now to FIG. 23, a second alternate embodiment of the present invention is shown. Cervical protection system 100, as different from the first alternate embodiment, teaches initiator 130 mounted outside hollow collar 105. It should be understood that initiator 130 may be mounted anywhere about helmet 101. However, in the preferred embodiment, initiator 130 is mounted in the neck roll region 75 in the interior of helmet 101 as shown in FIG. 21. While the neck roll region 75 is the preferred mounting location, it should further be understood that initiator 130 can be mounted anywhere around the top surface 204 of hollow collar 105. Or, anywhere around the outer surface 303 or inner surface 306 of hollow collar 105.

Figure 24:
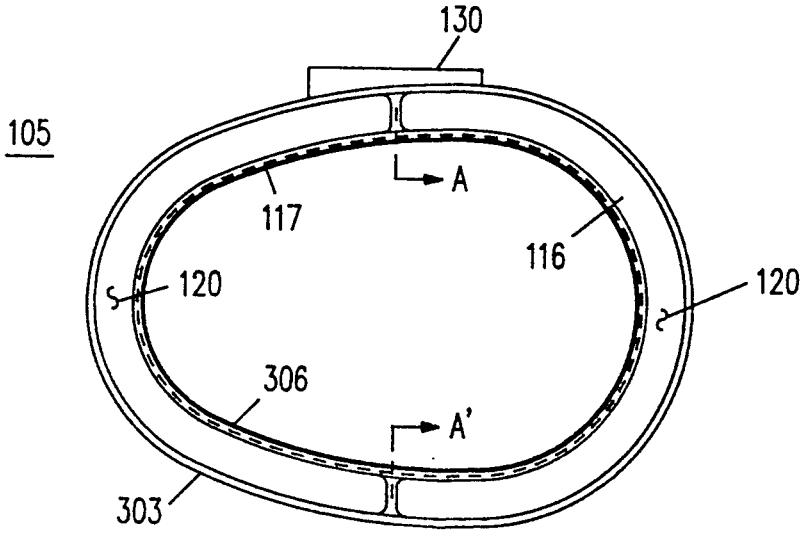
FIG. 24 shows a bottom view of the deployable cervical collar of FIG. 23.

FIG. 24 shows a bottom view of collar 105 shown in FIG. 23.

It should be understood that some wearers of helmets may not desire being attached to a vehicle via tether 136. Some wearers may not desire having a cervical protection system deploy during impact. Furthermore, some injuries may not be preventable with a cervical protection system deploying prior to impact. Thus, the present invention teaches that tether 136 can be pulled after impact to deploy bag 110 and provide an instant cervical collar therein. Anyone providing first aid or even wearer 220, if possible, could activate the instant cervical collar by pulling tether 136. In such case, it may be preferred that bag 110 be inflated slowly to avoid rapid movement of neck 77. Thus, a narrow opening may be created in gas capsule 115 for slowly inflating bag 110. For inflating during impact, bag 110 may be inflated rapidly as described elsewhere herein.

Figure 25:
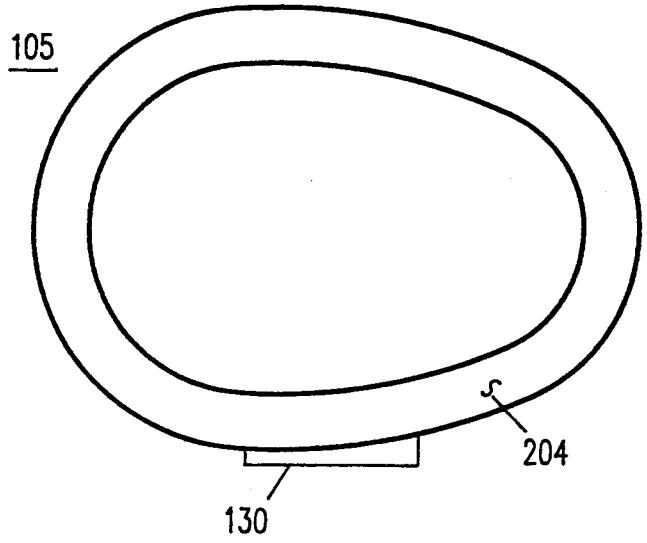
FIG. 25 shows a top view of the deployable cervical collar of FIG. 21.
Figure 26:
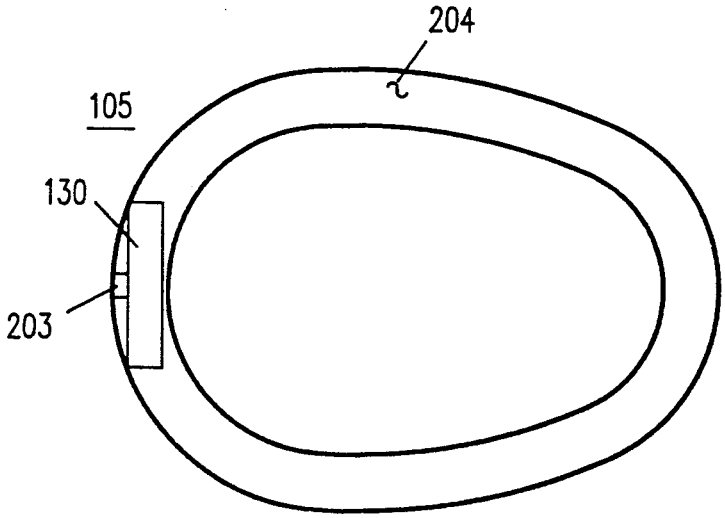
FIG. 26 shows a top view of the deployable cervical collar of FIG. 23.

FIGS. 25 and 26 show to views of hollow collar 105 and shown in FIGS. 24 and 22 respectively. As an alternative to clips 202, top surface 204 and the bottom periphery of helmet 101 could comprise a hook and loop fastener material for removably mounting hollow collar 105 to helmet 101. Additionally, it should be understood that helmet 101 can contain threads for mating with collar 105. Threading may be disposed on top surface 204. Thus, helmet 101 can be removed by slightly twisting the helmet from collar 105 to disengage the threads. This type of attachment is well known in the art of the present invention. As shown in FIG. 26, a groove 203 may be included to provide an opening for tether 136 when hollow collar 105 is mounted to helmet 101. Bottom of helmet 101 is substantially similar to top surface 204 as shown in FIG. 25 with the exclusion of initiator 130. Also, capsule 115, and thus initiator 130, can be mounted vertically in helmet 101 not shown with respect to FIG. 26.

Figure 27:
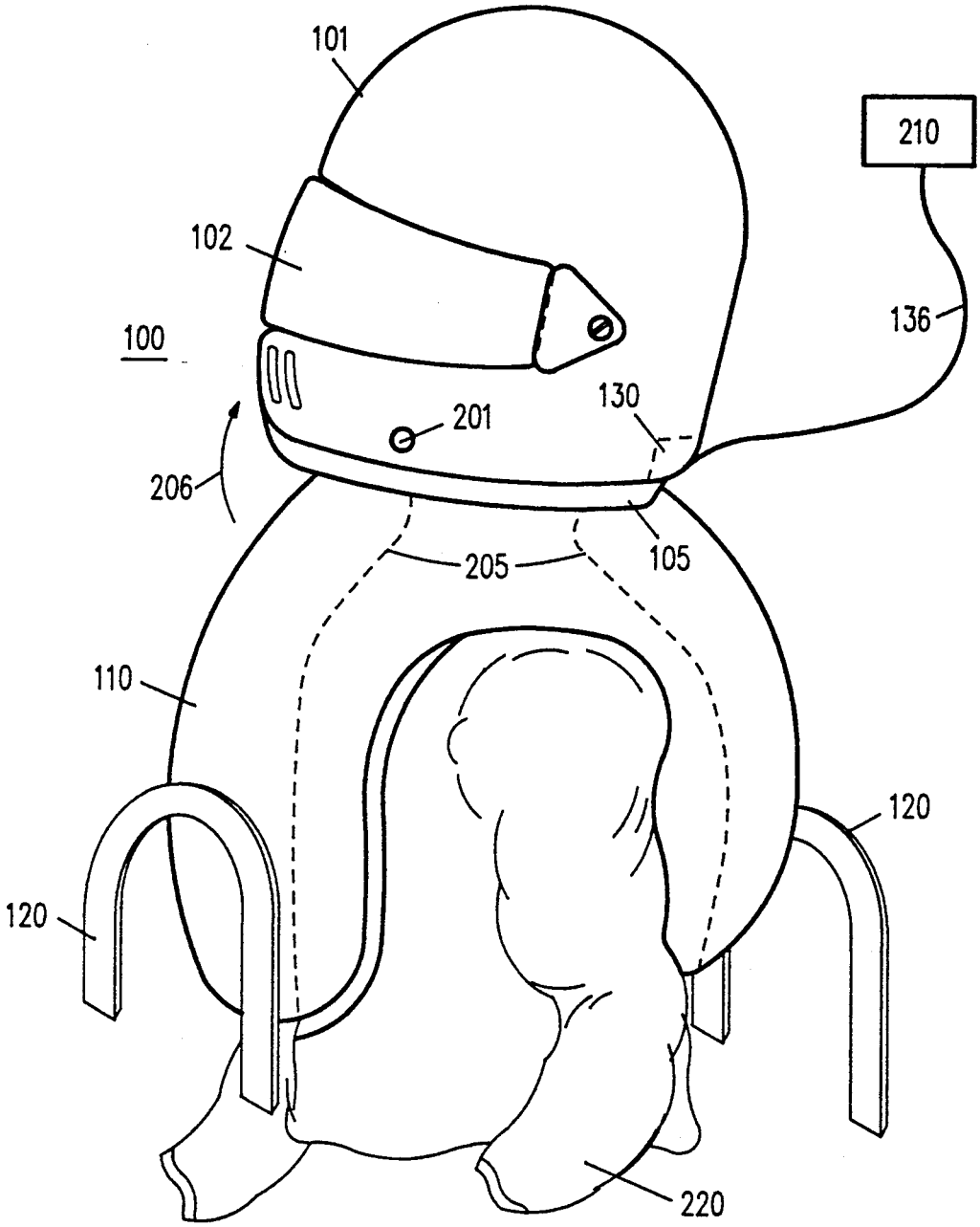
FIG. 27 shows a perspective view of the deployable cervical collar fully deployed.

Referring now to FIG. 27, a perspective view of the instant cervical collar fully deployed is shown. Cervical protection system 100 is coupled to a vehicle 210 through tether 136. As explained elsewhere in the specification, once a wearer 220 is separated from vehicle 210 tether 136 causes initiator 130 to deploy bag 110. Neck/trunk profile lines 205 of wearer 220 show how bag 110 extends under the lower jaw in the front and the occipital area in the back of wearer 220. Bag 110, when deployed, positions the wearer's head in slight extension 206.

Figure 28:
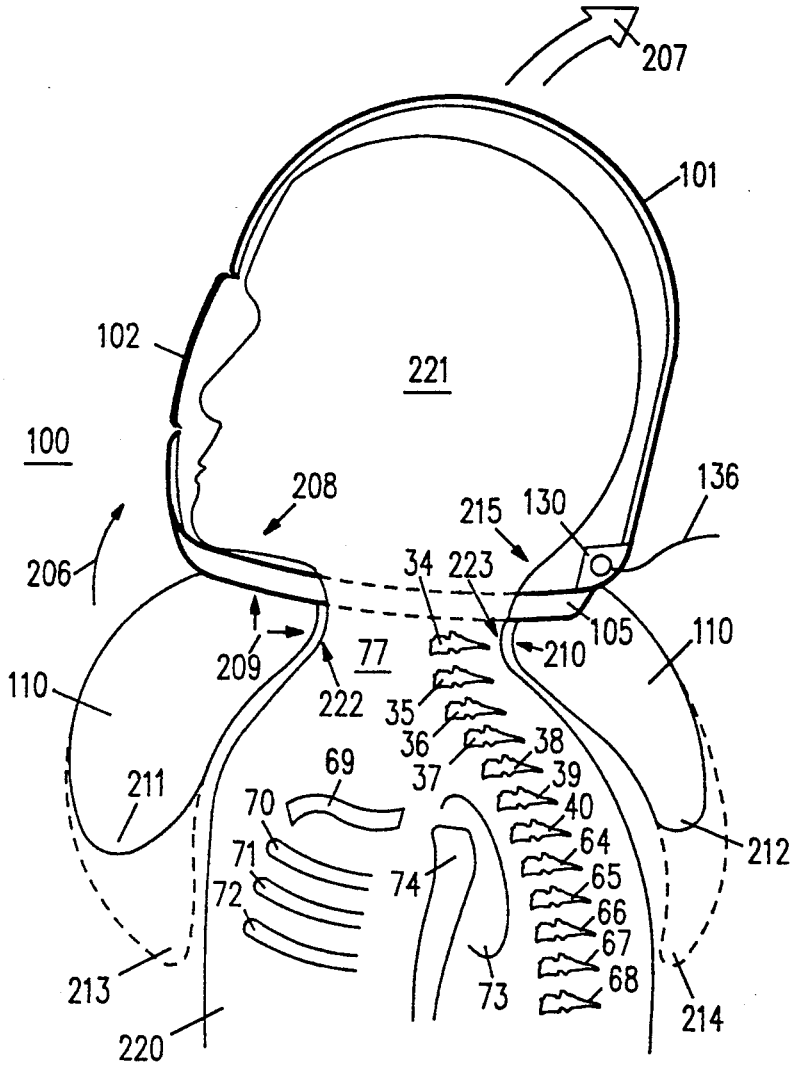
FIG. 28 shows a cross-sectional view of FIG. 27.

In FIG. 28, a substantially cross-sectional view of FIG. 27 is shown. Bag 110 when fully deployed, extends under lower jaw 208 of head 221 of wearer 220. Frontal inner contour 210 of bag 110 extends inwardly toward the front surface 222 of the neck 77 of wearer 200. Inner contour 210 of bag 110 further extends upwardly toward lower jaw 208 of wearer 220. The combination of inward and upward extension of contour 209 of air bag 110 when deployed provides slight extension 206 movement and maintaining of head 221 of wearer 220. Bag 110 may contain baffling (not shown) for gas distribution. Baffling may improve and maintain the shape of bag 110 when deployed. In which case a plurality of tubes 135 may be used for various sections of bag 110.

Slight extension 206 can be further described with reference to cervical vertebrae 34–40. Cervical vertebrae 34–40 represent the first through seventh cervical vertebrae respectively. When in slight extension 206, cervical vertebrae 34–40 can be medically described as curved, concave dorsally. It should be understood by those with ordinary skill in the art, that slight extension does not equate to overly extending head 221 of wearer 220. Rather, slight extension is only sufficient for maintaining blood flow to and from head 221. Furthermore, slight extension is for maintaining air way patency to and from head 221. The advantages of maintaining slight extension are well known to those with ordinary skill in the medical arts.

Bag 110 also provides inner contour 210 for extending inwardly toward the nape of the neck 223. In this manner, bag 110 extends under occipital area 215 of head 221. In this manner, inner contour 210 of bag 110 provides limiting the amount of extension of head 221. Additionally, inner contour 210 of bag 110 also provides slight extension of head 221 when wearer 220 is so oriented. For example, if wearer 220 was lying on the ground, inner contour 210 would provide a pivotal area for holding the wearer's head 221 in slight extension.

Bag 110 extends in the front to contour 211. Bag 110 thus covers clavicle 69, rib 70 and rib 71. Bag 110 may optionally extend further. For example, bag 110 may extend to contour 213 to cover rib 72 as well. Bag 110 in the back of wearer 220 extends to contour 212. Contour 212 covers the first seven cervical vertebrae 34–40 of wearer 220. Bag 110 may optionally extend to contour 214. Contour 214 covers an additional five vertebrae, namely the first five thoracic vertebrae 64–68. Additionally, humorous 74 and scapula 73 are shown for reference. As explained elsewhere herein, bag 110 when deployed extends on the shoulders of wearer 220. It should further be understood that bag 110 circumferentially extends around the neck 77 of wearer 220. Also, it is preferable that bag 110 be made to continuously circumferentially extend around the neck 77 of wearer 220. This aids in preventing unwanted removal of bag 110 by continuously circumferentially it should be understood that this precludes a bag in the form of a strip, e.g. tubing, which raps around the neck.

Helmet 101 can be removed from the wearer's head 221 in a direction 207. Direction 207 is an arching motion for removing helmet 101.

Figure 29:
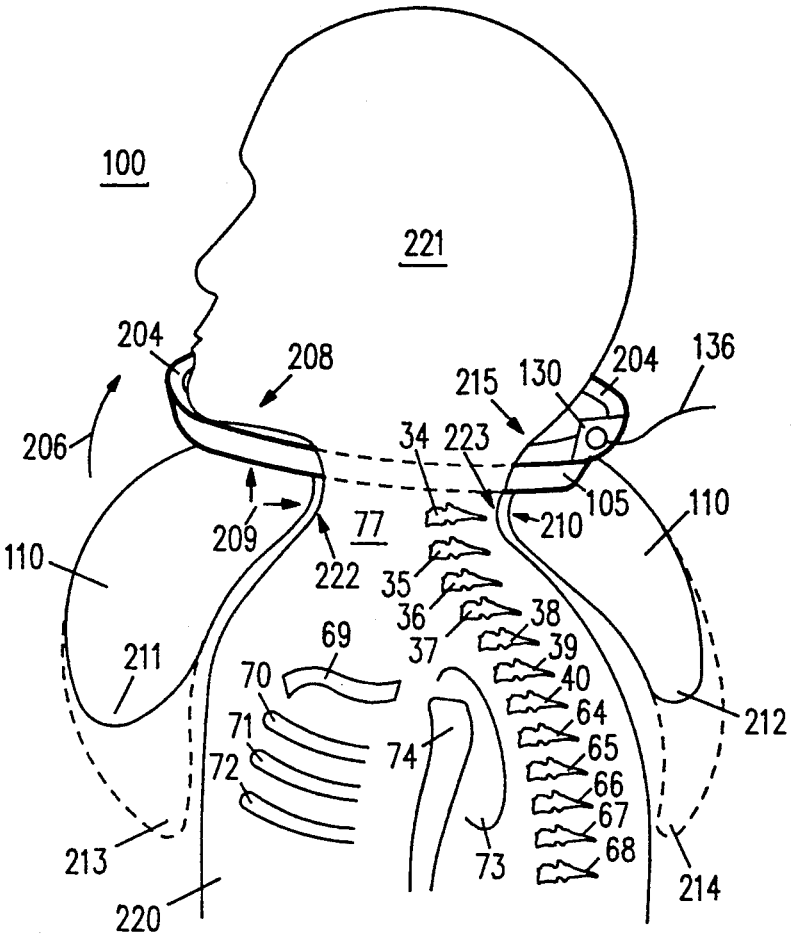
FIG. 29 shows a cross-sectional view as in FIG. 28, except the helmet is removed.

In FIG. 29, the cross-sectional view as shown in FIG. 28 is shown with helmet 101 removed. As shown, helmet 101 may be removed for treating areas of the wearer's head 221, while maintaining slight extension with bag 110 deployed. Also, it should be understood that because bag 110 maintains the neck of wearer 220 from unwanted movement, only one person rendering aid is required to remove helmet 101. Further, it should be understood that chin-straps which are easily released are preferred. Thus, chin-strap release 201, as provided on some helmets, is preferred. The chin-strap typically must be released prior to removal of helmet 101. With helmet 101 removed, wearer 220 can be treated, e.g., mouth to mouth resuscitation, as required.

Figure 30:
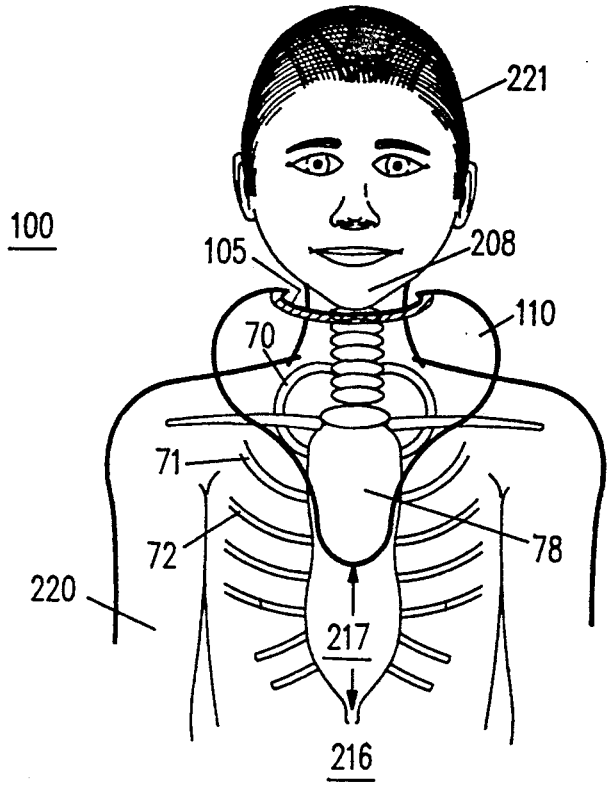
FIG. 30 shows a front view of FIG. 29.
Figure 31:
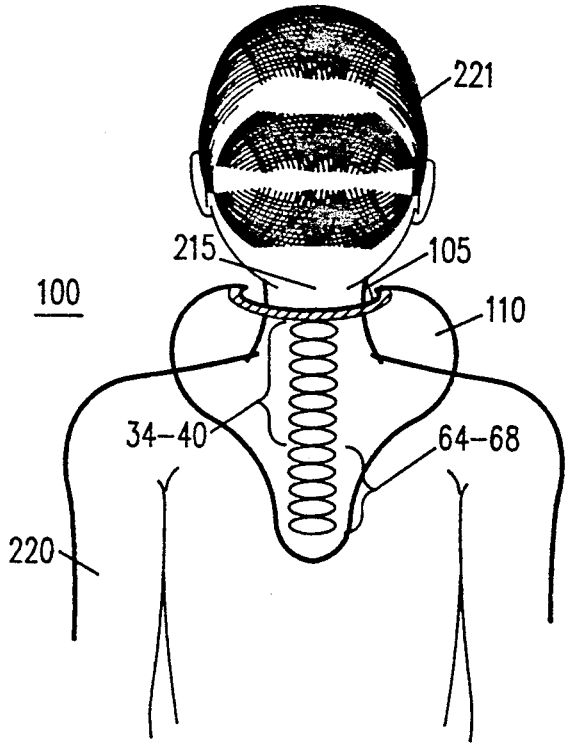
FIG. 31 shows a rear view of FIG. 29.

Referring to FIGS. 30 and 31, a front and rear view, respectively, of FIG. 29 is shown. In front of wearer 220 as indicated is xiphoid process 216. The bottom 224 of air bag 110 indicates the approximate location for rendering Cardiopulmonary Resuscitation (CPR) to the heart of wearer 220. The present invention teaches that bag 110 should not overly extend in front of wearer 220. To avoid being in the way of providing CPR, the present invention teaches that the bottom 224 of bag 110 should extend to approximately one hand width above the xyphoid process 216. Distance 217 represents approximately one hand width from the bottom 224 of bag 110 to xyphoid process 216. Also, as shown in FIG. 31, bag 110 may extend to cover thoracic vertebrae 64–68. Bag 110 should at least extend to the beginning of sternum region 78. Therefore, bag 110 may extend in front to at least cover the seventh cervical vertebrae 40.

Further, it should be understood that individual wearers physical features will vary. Thus, bag 110 may be custom fitted to each individual. Also, bag 110 may be provided in a variety of shapes and sizes.

Figure 32:
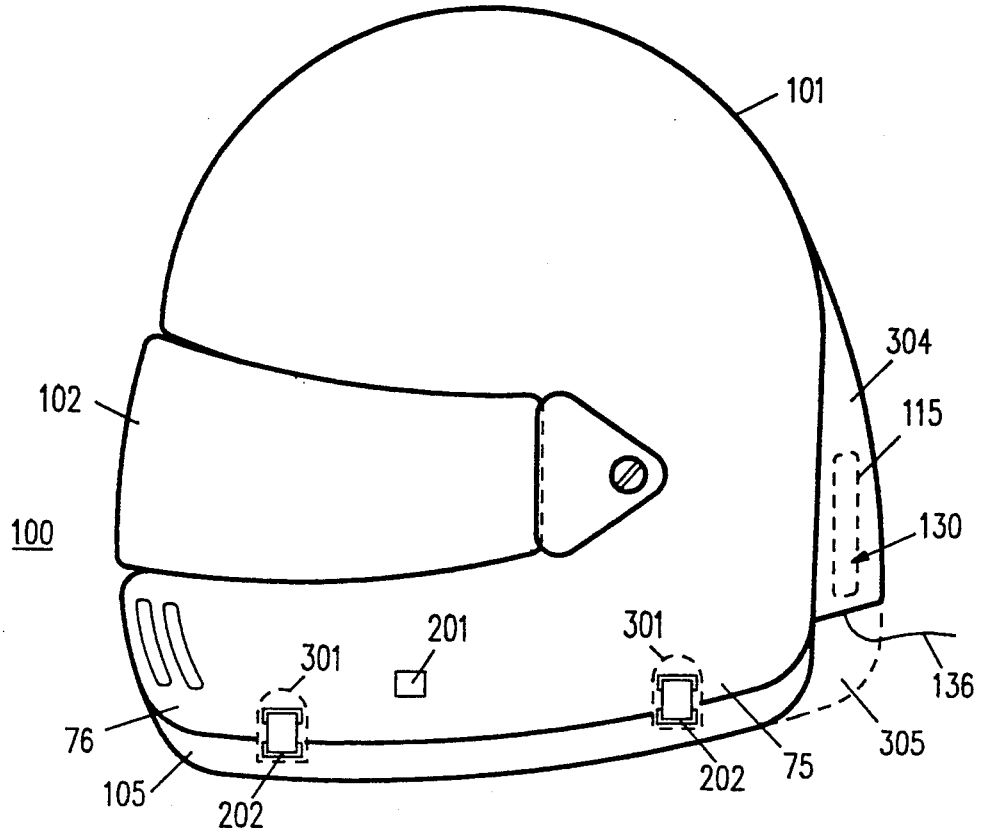
FIG. 32 shows a third alternate embodiment of the present invention providing a deployable cervical collar.

Referring now to FIG. 32, a third alternate embodiment of the present invention is shown. In FIG. 32, addition 304 is mounted to helmet 101. Addition 304 provides additional space for mounting initiator 130 to helmet 101. As shown, capsule 115 can be mounted vertically within addition 304. Addition 304 can be mounted to helmet 101 in any of a variety of well-known ways, including gluing, cementing, molding, clipping, hook and loop fastening and welding among others. Additionally, when addition 304 is used, collar 105 can alternatively be made to extend to region 305.

Figure 33:
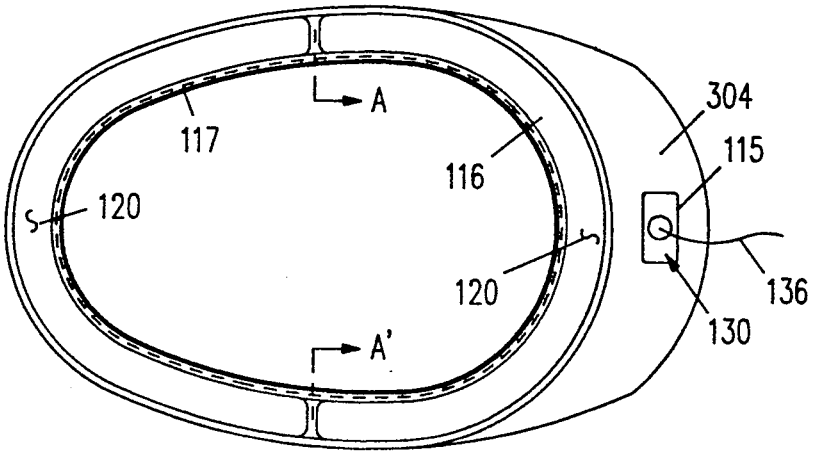
FIG. 33 shows a bottom view of the deployable cervical collar of FIG. 32.

As shown in FIG. 33, the bottom of collar 105 and helmet 101 of FIG. 32 is shown. As shown, addition 304 extends to form a mounting location for capsule 115 of initiator 130. As shown in FIG. 33, additional region 305 is not included. However, if region 305 was included, it should be understood that channel 117, seals 120, and opening 116 may extend outwardly to encompass the bottom periphery of addition 304.

Figure 34:
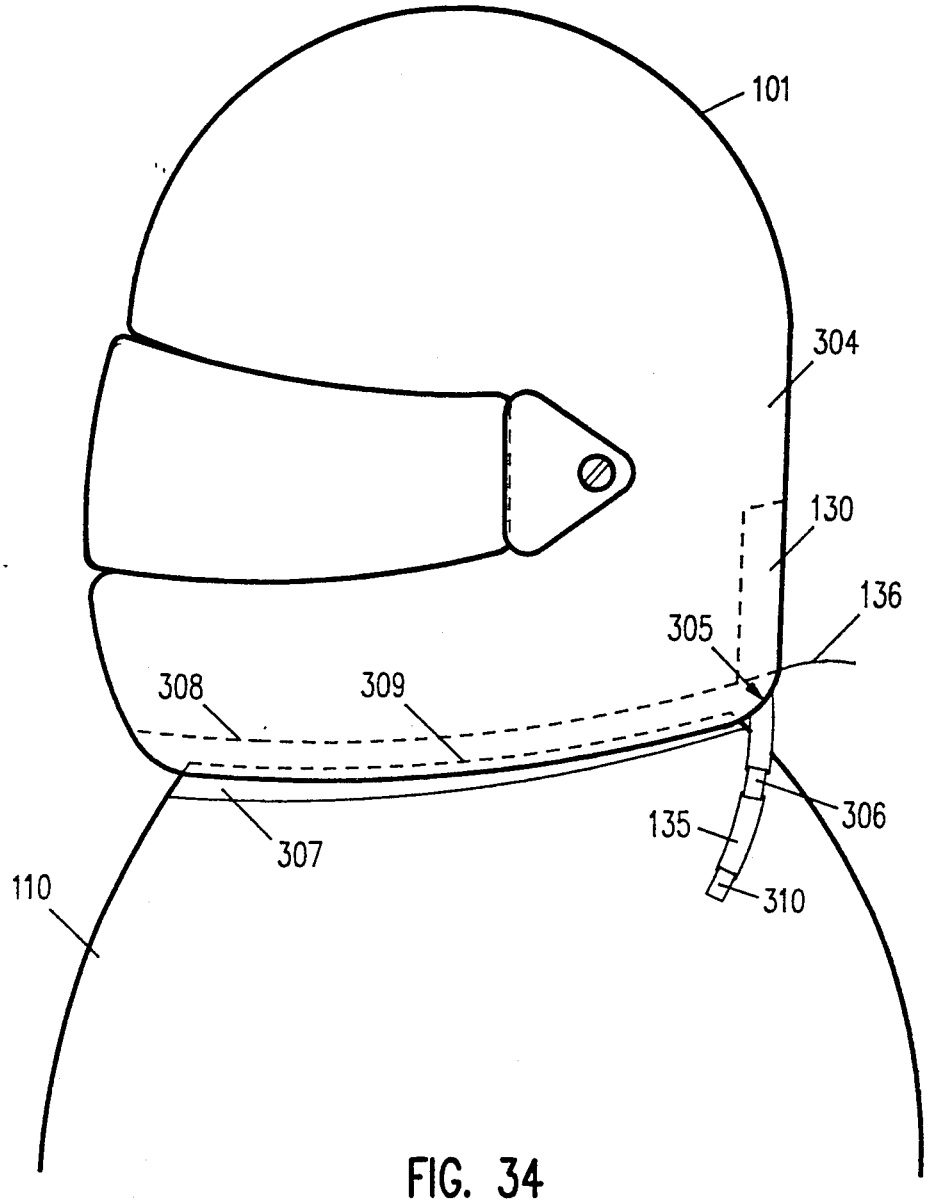
FIG. 34 shows a partial view of the deployable cervical collar deployed.

Now referring to FIG. 34, a partial deployed view of bag 110 and helmet 101 is shown. In FIG. 34, collar 105 is not shown, as it has been made integral to helmet 101. It should be understood that collar 105 can be included in the design of helmet 101 by providing a region 308 for maintaining bag 110. Additionally, as shown, addition 304 is made integral to helmet 101, as also is region 305. In order to make bag 110 portable and detachable from helmet 101, it is shown that bag 110 is not connected to helmet 101 after being deployed. As shown, a space 307 may exist between helmet 101 and bag 110. Thus, bag 10 deploys as a bag encircling the neck of the wearer, as shown and described herein. Additionally, bag 110 may extend under helmet 101 as shown with reference to dashed line 309. In this manner, helmet 101 may be removed from the wearer and still maintain bag 110 in place. For this purpose, tube 135 includes a quick disconnect 306 and a one-way valve 310. While not shown in other Figures, it should be understood that one-way valve 310 and quick disconnect 306 may be included with other embodiments of the present invention. One-way valve 310 can include any of the variety well known one-way valves suitable for the purposes of the present invention. Additionally, any of a variety of well known quick disconnects 306 may be used with the present invention.

It should be understood that the present invention teaches having replaceable capsules 115 for maintaining bag 110 in a deployed state. However, it should further be understood that capsule 115 as mounted in to initiator 130 is for a single deployment. Therefore, quick disconnect 306 may be connected to another capsule for maintaining inflation of bag 110 as required. Capsule 115 on the other hand of initiator 130 is intended for a single use.

The present invention has been particularly shown and described with respect to certain preferred embodiments of features thereof. However, it should be readily apparent to those of ordinary skill in the art that various changes and modifications in form and detail may be made without departing from the spirit and scope of the invention as set forth in the appended claims. The invention illustratively disclosed herein may be practiced without any element which is not specifically disclosed herein.

I claim:

1. A deployable cervical protection system for a wearer, the system for mitigating to preventing injury to the wearer due to impact, the system comprising in operative combination:

an impact resistant helmet including a bottom periphery;

a hollow collar having an elongated opening, the hollow collar removably mounted to the bottom periphery, the hollow collar including two channels formed in opposing edges of the elongated opening;

an inflatable bag constructed of an abrasion resistant material, the bag adapted to be inflated with gas, the bag in collapsed form being disposed within a hollow region defined by the hollow collar so that head movement is substantially unrestricted;

a flexible seal including two horseshoe shaped strips, the strips each attached to an outer surface of the bag, the strips adapted to mate with the two channels for packing and sealing the bag into the hollow region defined by the hollow collar; and a source of gas removably mounted on the helmet and coupled to the bag for deploying the bag by inflation thereof;

the bag being deployable from the hollow collar, deployment of the bag being produced by filling the bag with gas under pressure;

the bag in deployed configuration having an anterior and a posterior contour, the anterior contour and posterior contour in combination extending circumferentially around the neck of the wearer, the anterior contour extending from the bottom periphery of the helmet to approximately the midsternal area in the front of the wearer, the posterior contour extending from the bottom periphery of the helmet to approximately the fifth thoracic vertebrae in the back of the wearer, the anterior contour and the posterior contour in combination extending to approximately midway between the sternal mastoid muscle group and the lateral tip of the scapula of the wearer;

the bag in deployed configuration providing means for effectively limiting flexion-extension and rotation about a horizontal axis;

the anterior contour and the posterior contour having a base, the base located about a region where the bag is connected to the hollow collar, the bag being extended at the base;

the bag effectively limiting rotation about a vertical axis.

2. A system as in claim 1 wherein the source of gas includes a spring driven piercing mechanism and at least one pressurized gas capsule, the piercing mechanism disposed adjacent to the capsule, and the spring driven piercing mechanism located in close proximity to the gas capsule to initiate deployment of the bag by rupturing a seal on the capsule that allows gas to escape into the bag.

3. A system as in claim 2 wherein the source of gas further includes means for activating the piercing mechanism.

4. A system as in claim 3 wherein the means for activating the piercing mechanism comprises a pull-pin.

5. A system as in claim 4 wherein the pull-pin is attached to a vehicle by a cable so that the deployable cervical protection system is activated when the wearer is suddenly separated from the vehicle.

6. A system as in claim 3 wherein the capsule and the piercing mechanism are located in the low occipital area of the wearer and outside but integral to the helmet.

7. A deployable cervical device for a wearer which is attachable to a helmet, the helmet having a chin bar and a neck roll, the deployable cervical device comprising in operative combination:

a collar having a bottom periphery, the bottom periphery defining an elongated opening, the elongated opening providing a substantially hollow region in the collar;

coupling means for removably attaching the collar to the chin bar and neck roll regions of the helmet;

an inflatable bag adapted to be inflated with gas, the bag in collapsed form disposed within the hollow region of the collar; and an inflation means coupled to the bag and the collar for inflating the bag, the inflation means including a pressurized gas capsule for providing the gas to inflate the bag, the bag being deployed from the hollow region of the collar when inflated with the gas;

the bag in deployed configuration extending circumferentially around the neck of the wearer, extending under the jaw in the front of the wearer, extending down to the sternum region in the front of the wearer, extending under the occipital area in the back of the wearer, extending down to at least the seventh cervical vertebrae in the back of the wearer, and extending laterally on the shoulders of the wearer;

the bag in deployed configuration providing means for effectively limiting flexion-extension of the cervical spine of the wearer about a horizontal axis, limiting rotation of the cervical spine of the wearer about a horizontal and a vertical axis, and maintaining the head of the wearer in slight extension.

8. A device as in claim 7 wherein the inflation means further includes a spring driven piercing mechanism disposed adjacent to the gas capsule, and the spring driven piercing mechanism being located in close proximity to the gas capsule to initiate deployment of the bag by rupturing a seal on the gas capsule.

9. A device as in claim 8 wherein the inflation means further comprises means for activating the piercing mechanism.

10. A device as in claim 9 wherein the means for activating the piercing mechanism includes a pull-pin coupled to a tether.

11. A device as in claim 10 wherein the tether is attached to a vehicle so that the deployable cervical device is activated when the wearer becomes suddenly separated from the vehicle.

12. A device as in claim 9 further comprising a flexible sealing means disposed in the elongated opening for securing the bag in the hollow region of the collar.

13. A device as in claim 9 wherein the inflation means is disposed in the neck roll region interior to the helmet.

14. A device in claim 9 wherein the inflation means is disposed outside and integral to the collar.

15. A device as in claim 7 wherein the bag in deployed configuration extends to the fifth thoracic vertebrae region of the wearer.

16. A device as in claim 7 wherein the bag in deployed configuration extends to midway between the sternomastoid muscle group and the lateral tip of the scapula on the shoulders of the wearer.

17. A device as in claim 1 wherein the gas capsule is for a single use for deploying the bag.

18. A cervical protection helmet for a wearer comprising:

an inflatable bag disposed within a hollow collar region of and defined by the helmet; and an inflation means disposed in a defined contour of the helmet, the inflation means coupled to the bag through a tube means for inflating the bag when initiated, the inflation means including a capsule, the capsule for providing a substance for inflating the bag;

the bag is deployed configuration extending continuously circumferentially around the neck of the wearer, extending under the jaw in the front of the wearer, extending under the occipital area in the back of the wearer, extending down to the sternum region in the front of the wearer, extending down to at least the seventh cervical vertebrae in the back of the wearer, and extending laterally on the shoulders of the wearer;

the bag being disconnectable from the helmet after deployment of the bag.

19. A helmet as in claim 18 further comprising a disconnect means for disconnecting the bag from the helmet, and including a one-way valve for preventing deflation of the bag after disconnecting from the helmet.

20. A helmet as in claim 18 wherein the capsule is for a single use.

* * * * *